US011807929B2

(12) United States Patent
Tajiri et al.

(10) Patent No.: US 11,807,929 B2
(45) Date of Patent: Nov. 7, 2023

(54) THERMALLY STABILIZED NICKEL-COBALT MATERIALS AND METHODS OF THERMALLY STABILIZING THE SAME

(71) Applicant: Unison Industries, LLC, Jacksonville, FL (US)

(72) Inventors: Gordon Tajiri, Waynesville, OH (US); Emily Marie Phelps, Bellbrook, OH (US); Joseph Richard Schmitt, Springfield, OH (US); Lakshmi Krishnan, Clifton Park, NY (US); Guru Venkata Dattu Jonnalagadda, Ponnur (IN); Gary Stephen Shipley, West Chester, OH (US); Ashley Rose Dvorak, Fairborn, OH (US)

(73) Assignee: Unison Industries, LLC, Jacksonville, FL (US)

( * ) Notice: Subject to any disclaimer, the term of this patent is extended or adjusted under 35 U.S.C. 154(b) by 284 days.

(21) Appl. No.: 16/794,438

(22) Filed: Feb. 19, 2020

(65) Prior Publication Data

US 2020/0291508 A1 Sep. 17, 2020

Related U.S. Application Data

(60) Provisional application No. 62/818,270, filed on Mar. 14, 2019.

(51) Int. Cl.

| | |
|---|---|
| ***C22F 1/10*** | (2006.01) |
| ***C22C 19/03*** | (2006.01) |
| ***C25D 3/12*** | (2006.01) |

(52) U.S. Cl.

CPC ..... *C22F 1/10* (2013.01); *C22C 19/03* (2013.01); *C25D 3/12* (2013.01); *C22C 2200/02* (2013.01)

(58) Field of Classification Search

CPC .... C22F 1/10; C22F 1/002; C22F 1/02; C22C 19/03; C22C 2200/02; C22C 19/07;

(Continued)

(56) References Cited

U.S. PATENT DOCUMENTS

| | | | |
|---|---|---|---|
| 7,320,832 | B2 | 1/2008 | Palumbo et al. |
| 8,052,810 | B2 | 11/2011 | Okada et al. |

(Continued)

FOREIGN PATENT DOCUMENTS

| | | | |
|---|---|---|---|
| CN | 102392276 | A | 3/2012 |
| CN | 105350041 | A | 2/2016 |

(Continued)

OTHER PUBLICATIONS

JP2012062538A, US10808306B2.

(Continued)

*Primary Examiner* — Anthony M Liang
*Assistant Examiner* — Danny N Kang
(74) *Attorney, Agent, or Firm* — McGarry Bair PC

(57) ABSTRACT

Nickel-cobalt materials, methods of forming a nickel-cobalt material, and methods of thermally stabilizing a nickel-cobalt material are provided. A nickel-cobalt material may include a metal matrix composite with amorphous regions and crystalline regions substantially encompassed by a nanocrystalline grain structure with a grain size distribution of about 50 nanometers to about 800 nanometers, and the nanocrystalline grain structure may include widespread intragranular twinning. The metal matrix composite may have a chemical makeup that includes nickel, cobalt, and a dopant such as phosphorus and/or boron. A nickel-cobalt material may be heat treated within a first temperature zone below the onset temperature for grain growth and then within a second temperature zone above the onset temperature for grain growth in the material. Chemical composition (Continued)

and heat treatment may yield a thermally stabilized nickel-cobalt material.

20 Claims, 15 Drawing Sheets

(58) Field of Classification Search
CPC ..... C22C 19/00; C25D 3/12; C25D 3/562; C25D 5/18
See application file for complete search history.

(56) References Cited

U.S. PATENT DOCUMENTS

| | | | | |
|---|---|---|---|---|
| 8,187,448 | B2 | 5/2012 | Rousseau et al. | |
| 8,352,266 | B2 | 1/2013 | Farmaner et al. | |
| 8,367,217 | B2 | 2/2013 | Gonzalez et al. | |
| 9,005,420 | B2 | 4/2015 | Tomantschger et al. | |
| 9,574,280 | B2 | 2/2017 | Ishikawa et al. | |
| 10,808,306 | B2 | 10/2020 | Chiba et al. | |
| 2007/0272559 | A1* | 11/2007 | Ho | C25D 3/562 205/255 |
| 2008/0202641 | A1 | 8/2008 | Hilty et al. | |
| 2010/0096850 | A1 | 4/2010 | Schuh et al. | |
| 2010/0304179 | A1 | 12/2010 | Facchini et al. | |
| 2012/0067464 | A1 | 3/2012 | Chiba et al. | |
| 2015/0322557 | A1 | 11/2015 | Etter et al. | |
| 2017/0191177 | A1 | 7/2017 | Whitaker et al. | |

FOREIGN PATENT DOCUMENTS

| | | | |
|---|---|---|---|
| CN | 107604397 | A | 1/2018 |
| EP | 1857572 | A2 | 11/2007 |
| JP | S51109224 | A | 9/1976 |
| JP | 2004315892 | A | 11/2004 |
| JP | 2008001975 | A | 1/2008 |
| JP | 2012062538 | A | 3/2012 |
| JP | 2013124404 | A | 6/2013 |
| JP | 2017197825 | A | 11/2017 |
| KR | 102030834 | B1 | 10/2019 |

OTHER PUBLICATIONS

JP2008001975A, Bibliographic Data.
JP2013124404, US9574280B2.
JP2017197825A, Bibliographic Data.
JP2004315892A, US8052810B2.
JPS2004315891A, Bibliographic Data.
CN102392276A, Bibliographic Data.
CN107604397A, Bibliographic Data.
CN105350041A, Bibliographic Data.
Lewandowski et al., Temperature rise at shear bands in metallic glasses, Department of Materials Science and Engineering, Case Western Reserve University, Cleveland, Ohio, Dec. 18, 2005, 4 pages.
European Search Report Corresponding to Application No. 20161706 dated May 20, 2020.

* cited by examiner

THERMALLY STABILIZED NICKEL-COBALT MATERIALS AND METHODS OF THERMALLY STABILIZING THE SAME

PRIORITY INFORMATION

The present application claims priority to U.S. Provisional Patent Application Ser. No. 62/818,270 filed on 14 Mar. 2019, which is incorporated by reference herein.

FIELD

The present disclosure generally pertains to thermally stabilized nickel-cobalt metal and methods of thermally stabilizing the same, including electrodeposited phosphorous-doped nickel-cobalt materials.

BACKGROUND

Nickel-cobalt materials are of interest for use in the manufacture of specialty components such as components for use in turbomachine engines and other aviation or aerospace settings requiring heat stability, high strength and ductility. However, some nickel-cobalt materials tend to exhibit a tradeoff between strength and ductility. Additionally, some nickel-cobalt materials tend to exhibit grain growth when utilized in high-heat environments which may modify the tensile properties of the material.

Accordingly, there exists a need for improved nickel-cobalt materials that exhibit thermal stability, high strength, and/or high ductility.

BRIEF DESCRIPTION

Aspects and advantages will be set forth in part in the following description, or may be obvious from the description, or may be learned through practicing the presently disclosed subject matter.

In one aspect, the present disclosure embraces nickel-cobalt materials. An exemplary nickel-cobalt material may include a metal matrix composite with amorphous regions and crystalline regions. The crystalline regions may be substantially encompassed by a nanocrystalline grain structure with a grain size distribution of about 50 nanometers to about 800 nanometers, and the nanocrystalline grain structure may include widespread intragranular twinning (e.g., about 30% to about 40%, or even about 40% to 50%, of the nanocrystalline grain structure comprising intragranular twinning). The metal matrix composite may have a chemical makeup that includes from about 50% to 80% by weight nickel, from about 20% to about 50% by weight cobalt, and from about 100 ppm to about 20,000 ppm by weight of a dopant. By way of example, the dopant may include phosphorus and/or boron.

In another aspect, the present disclosure embraces methods of forming a nickel-cobalt material. An exemplary method may include heat treating a nickel-cobalt material within a first temperature zone below the onset temperature for grain growth in the material. For example, the first temperature zone may be from about 600K to about 750K (about 326.9° C. to about 476.9° C.). An exemplary method may additionally or alternatively include heat treating the material within a second temperature zone above the onset temperature for grain growth in the material. For example, the second temperature zone may be from about 800K to about 900K (from about 526.9° C. to about 626.9° C.). The nickel-cobalt material may include a doped nickel-cobalt material, such as a doped nickel-cobalt material formed using an electrodeposition process.

In yet another aspect, the present disclosure embraces methods of thermally stabilizing a nickel-cobalt material. An exemplary method may include heat treating a nickel-cobalt material within a temperature zone below the onset temperature for grain growth in the nickel-cobalt material. The concentration of the cobalt in the nickel-cobalt material may be from about 30% to about 50% by weight. The nickel-cobalt material may include a dopant, and the concentration of the dopant in the nickel-cobalt material may be from about 1,000 ppm to about 2,500 ppm by weight.

These and other features, aspects and advantages will become better understood with reference to the following description and appended claims. The accompanying drawings, which are incorporated in and constitute a part of this specification, illustrate exemplary embodiments and, together with the description, serve to explain certain principles of the presently disclosed subject matter.

BRIEF DESCRIPTION OF THE DRAWINGS

A full and enabling disclosure, including the best mode thereof, directed to one of ordinary skill in the art, is set forth in the specification, which makes reference to the appended Figures, in which.

Figure 1B:
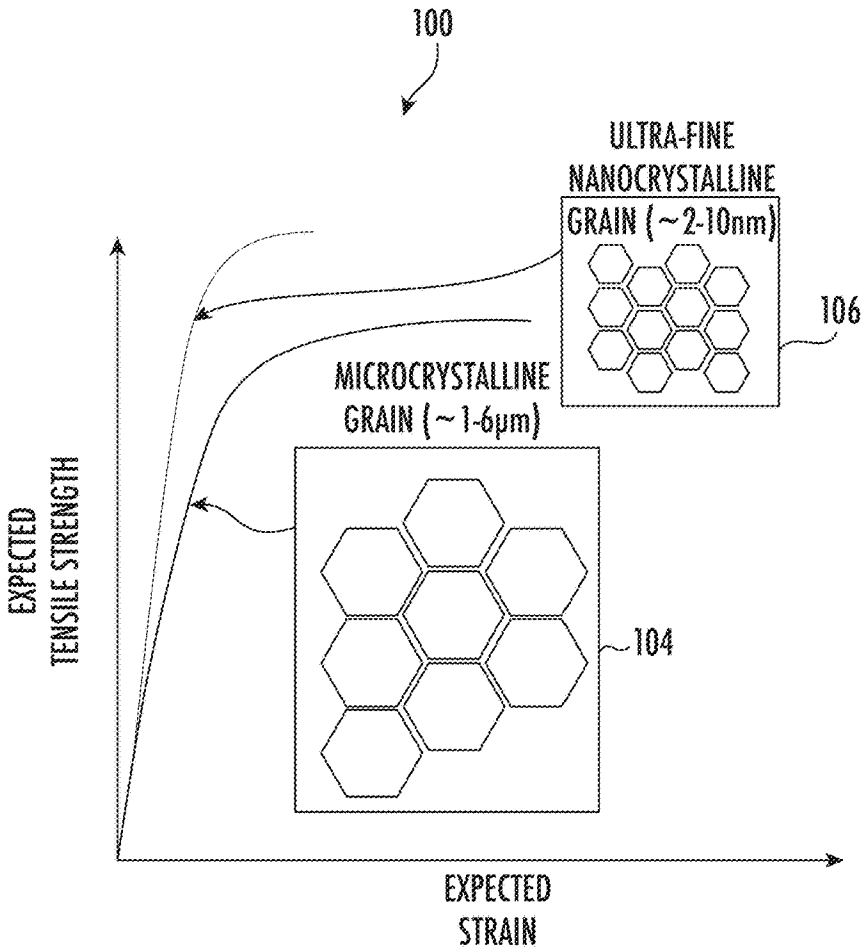
FIG. 1B shows an exemplary stress-strain curve generally comparing an ultra-fine nanocrystalline grain metal to a microcrystalline grain metal.

Repeat use of reference characters in the present specification and drawings is intended to represent the same or analogous features or elements of the present disclosure.

DETAILED DESCRIPTION

Reference now will be made in detail to exemplary embodiments of the presently disclosed subject matter, one or more examples of which are illustrated in the drawings. Each example is provided by way of explanation and should not be interpreted as limiting the present disclosure. In fact, it will be apparent to those skilled in the art that various modifications and variations can be made in the present disclosure without departing from the scope or spirit of the present disclosure. For instance, features illustrated or described as part of one embodiment can be used with another embodiment to yield a still further embodiment. Thus, it is intended that the present disclosure covers such modifications and variations as come within the scope of the appended claims and their equivalents.

The present disclosure generally provides thermally stabilized nickel-cobalt materials and methods of thermally stabilizing the same. The nickel-cobalt materials include nanocrystalline grain materials and metal matrix composites that include amorphous metal and crystalline grain regions. The nickel-cobalt materials may be formed by heat treating a precursor material produced using an electrodeposition process. By selectively tailoring the heat treatment schedule, a thermally stabilized nickel-cobalt material may be formed from the precursor material that has enhanced strength and ductility. Additionally, the precursor material may have a chemical composition and/or a micro structure selectively tailored based on the modifications to the grain structure to be carried out during the heat treatment process.

Exemplary nickel-cobalt materials may include a dopant which may provide Zener pinning ("pinning") that inhibits grain growth, and an elevated concentration of cobalt which may reduce or decrease the stacking fault energy of the material and thereby increases the proclivity for intragranular twinning. Exemplary dopants include aluminum, antimony, arsenic, boron, beryllium, cadmium, carbon, chromium, copper, erbium, europium, gallium, germanium, gold, iron, indium, iridium, lead, magnesium, manganese, mercury, molybdenum, niobium, neodymium, palladium, phosphorus, platinum, rhenium, rhodium, selenium, silicon, sulfur, tantalum, tellurium, tin, titanium, tungsten, vanadium, zinc, and/or zirconium. In some embodiments, a particularly suitable dopant may include phosphorous and/or boron. The pinning provided by the dopant may also encourage intragranular twinning. Individually or in combination, the dopant and/or the elevated concentration of cobalt may provide pinning and/or intragranular twinning during heat treatment which thermally stabilizes the nickel-cobalt material and enhances the ductility and tensile strength.

The heat treatment may include a precipitate strengthening heat treatment performed within a temperature zone below the onset temperature for grain growth. The precipitate strengthening heat treatment may form phosphorous precipitate alloys which may precipitate at grain boundaries and/or migrate to grain boundaries and thereby provide pinning that inhibits grain growth. The heat treatment may additionally include an annealing heat treatment performed within a temperature zone above the onset temperature for grain growth. The annealing heat treatment may provide controlled grain growth that introduces intragranular twinning which may be attributable to a lower stacking fault energy provided by an elevated level of cobalt in the nickel-cobalt material.

The resulting nickel-cobalt material may include a nanocrystalline structure with intragranular twinning that may be widespread throughout. For example, about 30% to about 40%, or even about 40% to 50%, or even greater than 50%, of the nanocrystalline structure may include intragranular twinning. Additionally, or in the alternative, the resulting nickel-cobalt material may include a composite material with amorphous metal regions and crystalline regions. In some embodiments, the composite material of the resulting nickel-cobalt material may include intragranular twinning, and such intergranular twinning may be widespread throughout the crystalline regions. For example, about 30% to about 40%, or even about 40% to 50%, or even greater than 50%, of the crystalline regions may include intragranular twinning. The crystalline regions may include a composite of nanocrystalline grain regions and coarse grain regions, as well as ultra-fine nanocrystalline grain regions.

The presently disclosed nickel-cobalt materials contain a selectively tailored concentration of nickel and cobalt, together with a phosphorous dopant. The particular concentration of nickel, cobalt, and phosphorous are selected so as to achieve the desired thermal stabilization, high strength, and enhanced ductility resulting from the presently disclosed heat treatment schedule. The nickel-cobalt material may have a multimodal metallic structure including a combination of amorphous regions and crystalline regions. The amorphous regions have a non-crystalline, glass-like structure. The crystalline regions may include ultra-fine nanocrystalline grain (UFNG) structures, which have a grain size distribution from about 2 to about 20 nanometers (e.g., from about 2 to about 10 nanometers), nanocrystalline grain (NG) structures, which have a grain size distribution from greater than about 20 to about 100 nanometers (e.g., from about 30 to about 90 nanometers), and coarse grain (CG) structures, which have a grain size distribution from greater than about 100 nanometers. Coarse grain structures include microcrystalline grain (MG) structures, which have a grain size distribution from about 1 to about 6 micrometers. The amorphous regions and crystalline regions, including the respective grain structures of the crystalline regions, may be distributed heterogeneously or homogeneously. Grain size may be measured using x-ray diffraction and/or scanning or transmission electron microscopy. With x-ray diffraction, grain size may be calculated using the Scherrer equation, a Williamson-Hall plot, or a Warren-Averbach model. With scanning or transmission electron microscopy, grain size may be measured either manually in accordance with ASTM E112, or semi-automatically in accordance with ASTM E1382.

Figure 1A:
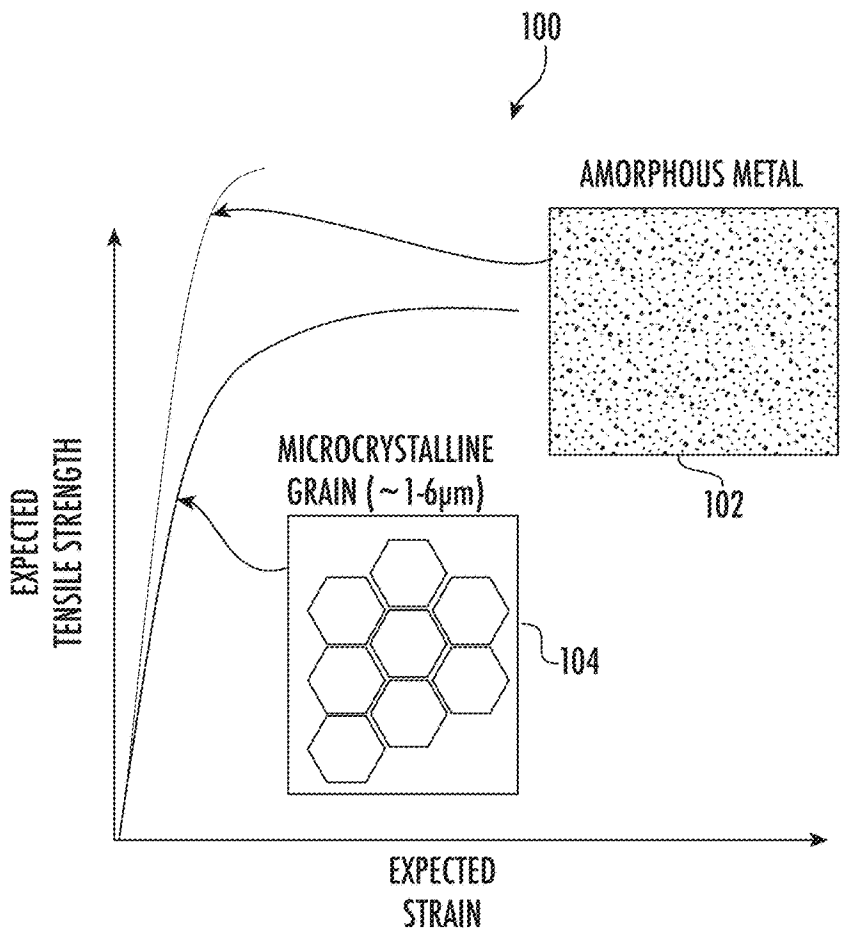
FIG. 1A shows an exemplary stress-strain curve generally comparing an amorphous metal to a microcrystalline grain metal.

FIGS. 1A and 1B show exemplary stress strain curves 100. These stress strain curves illustrate a typical tradeoff between strength and ductility. As shown in FIG. 1A, an amorphous structure 102 typically exhibits a relatively high tensile strength and relatively low ductility as compared to a microcrystalline grain structure 104. Conversely, the microcrystalline grain structure 104 typically exhibits a relatively higher ductility and a relatively lower tensile strength as compared to the amorphous structure 102. As shown in FIG. 1B, tensile strength typically increases with smaller grain sizes but the increase in strength with smaller grain sizes typically comes at the cost of lower ductility. For example, an ultra-fine nanocrystalline grain structure 106 may exhibit a relatively higher tensile strength and a relatively lower ductility as compared to a microcrystalline grain structure 104.

The relationship between strength and grain size is associated with interactions between dislocations and grain boundaries. Under an applied stress, dislocations existing within a crystalline lattice or initiated by plastic deformation propagate along slip planes across the crystalline lattice and along grain boundaries. The dislocations tend to accumulate at grain boundaries as the boundaries provide a repulsive stress in opposition to continued propagation of the dislocations. When the repulsive stress of a grain boundary exceeds the propagation force of the dislocations, the dislocations are unable to move past the grain boundary. As the dislocations accumulate, their collective propagation force increases, and the dislocations move across the grain boundary when their propagation force exceeds the repulsive stress of the grain boundary.

Decreasing grain size decreases the space available for possible accumulation of dislocations at the grain boundary, thereby increasing the amount of applied stress necessary for a dislocation to propagate across the grain boundary. The higher the applied stress needed to move the dislocation, the higher the yield strength. Accordingly, there is an inverse relationship between grain size and/or dislocation spacing and strength, which may be described by the Hall-Petch relationship (1) as follows:

$$\sigma \propto \frac{1}{\sqrt{a}}, \tag{1}$$

where σ is strength and α is the distance between grain boundary dislocations or precipitates. Thus, the strength of a material generally increases with decreasing grain size and increasing precipitates along grain boundaries according to the Hall-Petch relationship. The Hall-Petch relationship generally holds true up to a certain minimal dislocation or precipitate spacing, below which point a material tends to behave inversely to the Hall-Petch relationship. Accordingly, there is a limit to the increase in strength attainable by reducing dislocation or precipitate spacing, a, alone, and smaller grain size generally provides a lower ductility.

However, the presently disclosed nickel-cobalt materials may provide enhanced ductility and thermal stability, while still maintaining good strength. The enhanced ductility may be attributable at least in part to the phosphorous dopant, the level of cobalt in the nickel-cobalt alloy, the multi-modal composite structure of the alloy, and/or the heat treatment schedule performed upon the precursor material. Generally, each of these aspects may at least partially contribute to the ductility, tensile strength, and thermal stability of the presently disclosed phosphorous-doped nickel-cobalt alloys.

Figure 2:
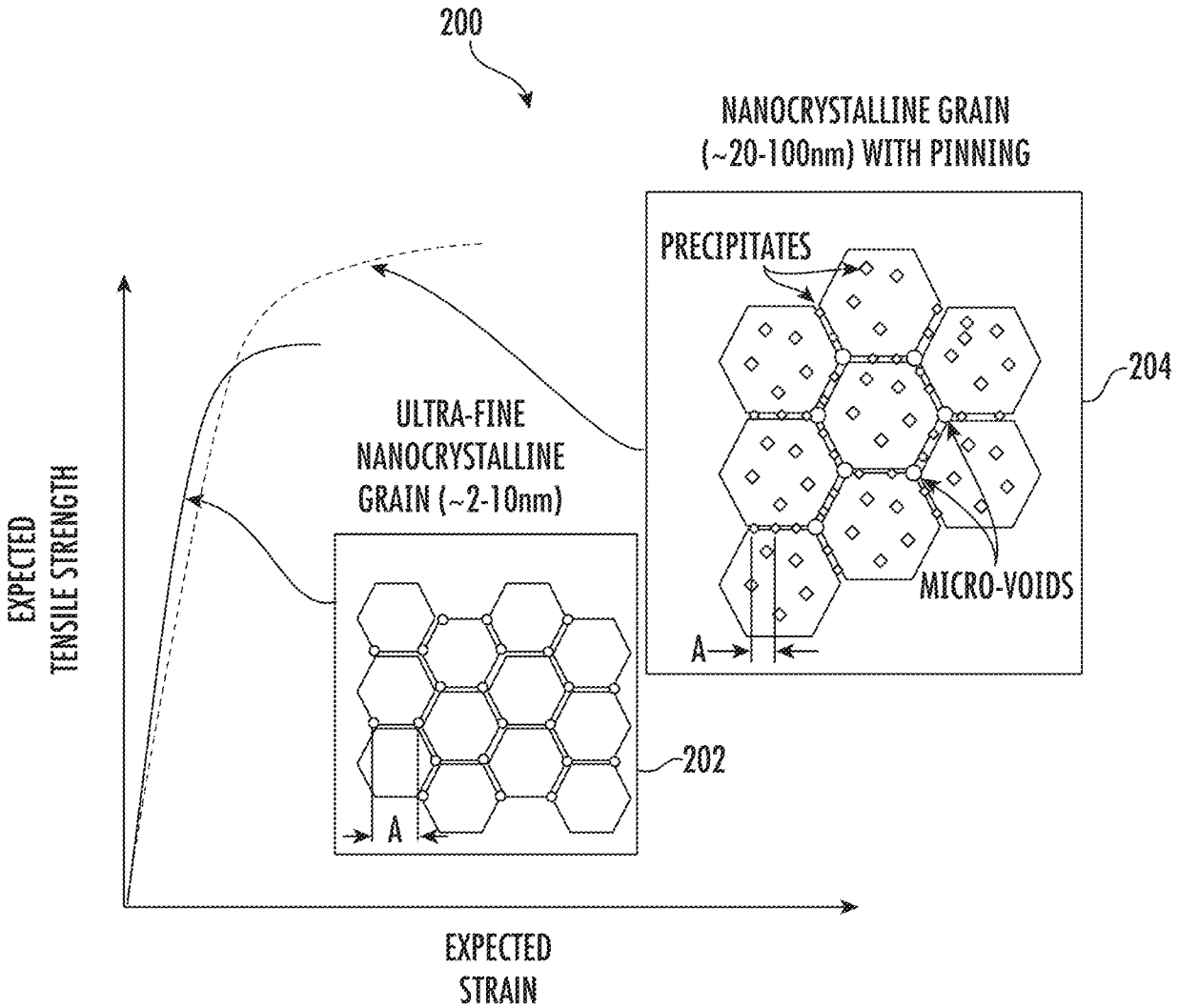
FIG. 2 shows an exemplary stress-strain curve generally comparing an ultra-fine nanocrystalline grain metal to a nanocrystalline grain metal with grain boundary pinning.

The precursor material may be subjected to precipitation or age strengthening heat treatments such that the phosphorous dopant causes Zener pinning, which may enhance both ductility and tensile strength and also provide thermal stability. FIG. 2 shows exemplary stress strain curves 200 which illustrate the effects of Zener pinning from precipitate strengthening heat treatment. As shown, an ultra-fine nanocrystalline grain structure 202 may exhibit good tensile strength but low ductility, whereas a nanocrystalline grain structure with pinning 204 may exhibit an increase in both tensile strength and ductility.

The precursor material may include a phosphorous dopant. During the electrodeposition process, the phosphorous dopant is deposited and dispersed through the crystalline lattice of the nickel-cobalt alloy. Heat treating the precursor material may form nickel-phosphorus and cobalt-phosphorous precipitate alloys. The nickel-phosphorous precipitates may include nickel phosphide ($Ni_3P$) and the cobalt-phosphorous precipitates may include cobalt phosphide ($Co_2P$). Some of the phosphorus alloys precipitate at grain boundaries and/or migrate to grain boundaries. Such precipitates act to prevent the motion of grain boundaries by exerting a pinning pressure which counteracts the driving force of the grain boundary, thereby inhibiting grain growth. Such pinning may inhibit grain growth during heat treatment, which may increase formation of intragranular twinning, thereby allowing for heat treatment that improves ductility while preserving tensile strength. Additionally, such pinning may inhibit grain growth under high temperature and/or high stress operating conditions, providing thermal stability for components formed of the presently disclosed phosphorous-doped nickel-cobalt alloy.

Figure 3:
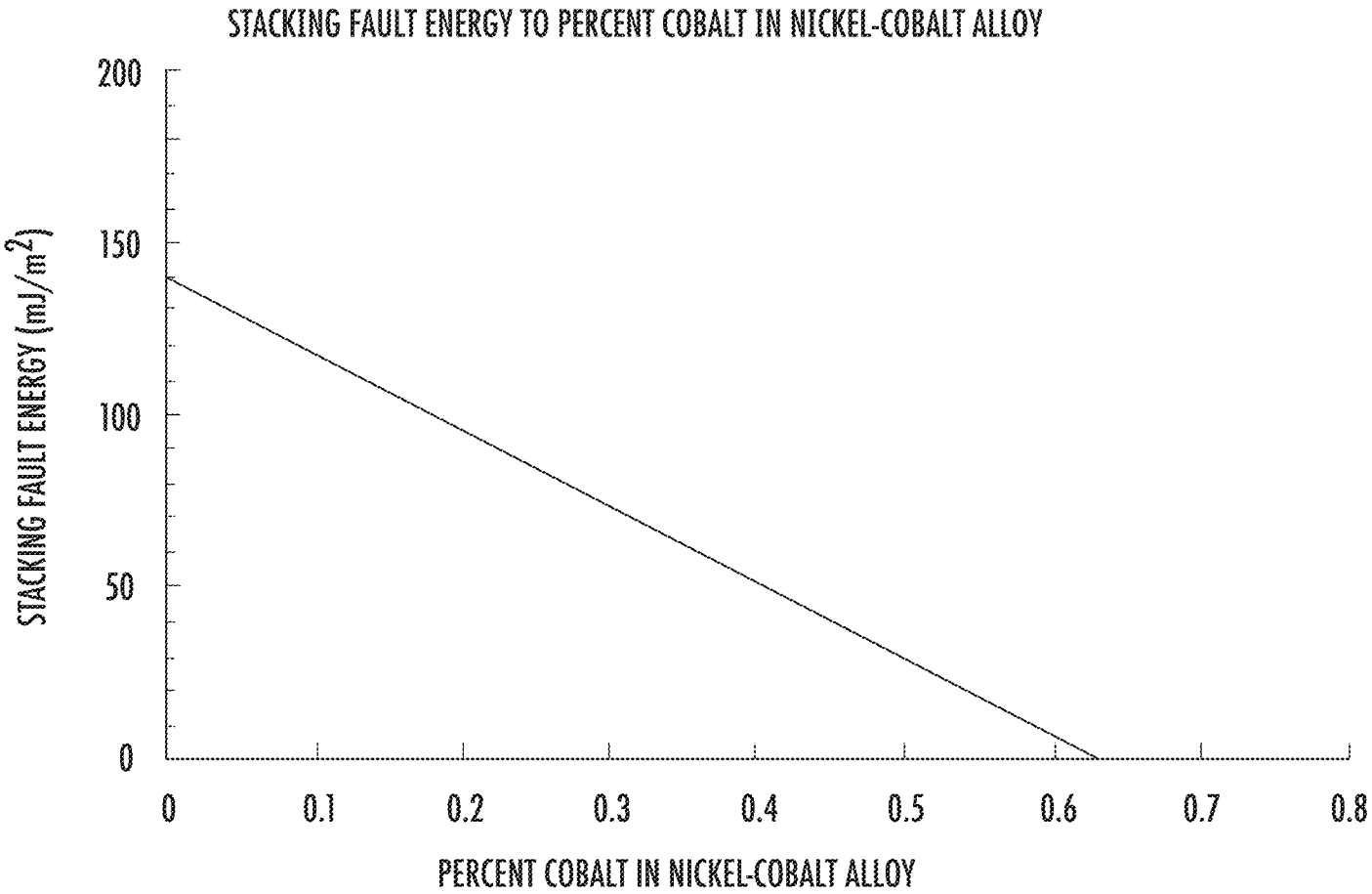
FIG. 3 shows a plot correlating stacking fault energy to percent cobalt in a nickel-cobalt alloy.

The precursor material may additionally or alternatively include an elevated level of cobalt, which lowers the stacking-fault energy, ysF of the nickel-cobalt alloy, thereby increasing the proclivity for intragranular twinning. Such intragranular twinning provides dislocation slip planes which may further enhance ductility and maintain or enhance tensile strength. FIG. 3 shows the general stacking fault energy relationship of nickel-cobalt alloys as a function of cobalt content. As shown in FIG. 3, the stacking fault energy of the nickel-cobalt alloy decreases as the percentage of cobalt in the alloy increases. As shown, a nickel-cobalt alloy with about 10% cobalt may have a stacking fault energy of about 125 $mJ/m^2$, whereas the alloy may have a stacking fault energy of about 75 $mJ/m^2$ with about 30% cobalt, or about 40 $mJ/m^2$ with about 40% cobalt.

Figure 4:
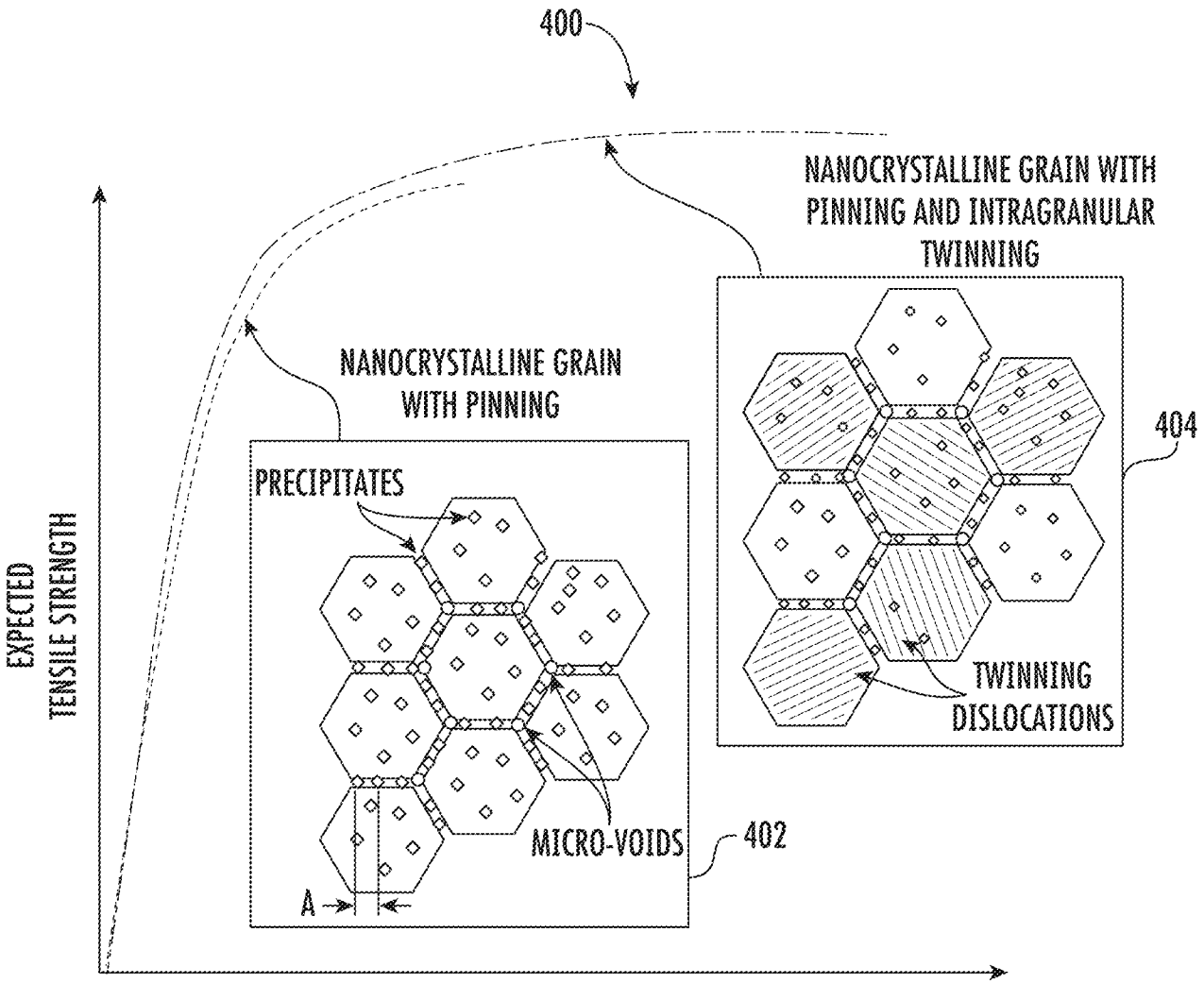
FIG. 4 shows an exemplary stress-strain curve generally comparing a nanocrystalline grain metal with pinning to a nanocrystalline grain metal with pinning and intragranular twinning.

FIG. 4. shows exemplary stress strain curves 400 which illustrate the effects of intragranular twinning. As shown, a nanocrystalline grain structure 402 with pinning may exhibit high tensile strength and moderate ductility, while a nanocrystalline grain structure with both pinning and intragranular twinning 404 may exhibit improved ductility while preserving or even improving tensile strength.

Intragranular twinning may occur during the electrodeposition process as well as during subsequent heat treatment. Additionally, intragranular twinning may also occur under high temperature and/or high stress operating conditions, further providing thermal stability for components formed of the presently disclosed nickel-cobalt alloy. Intragranular twinning may occur as a result of shear stresses introduced through pinning force constraining grain growth, which may arise from stacking faults located at constrained grain boundaries, as well as from grain boundary dissociations, grain encounters, and/or growth accidents exceeding the intragranular stacking fault energy.

Intragranular twinning may provide high ductility while retaining good tensile strength. The intragranular twins provide additional interfacial obstacles in the form of coherent twin boundaries which contribute to tensile strength in a similar manner as reduced grain size, yet these coherent twin boundaries provide slip planes that may contribute to ductility. The slip plane at intragranular twin boundaries may contribute to ductility and/or tensile strength in varying degrees depending on local geometric configurations and stresses. A pristine intragranular twin boundary may provide glissile motion, allowing for twin migration and corresponding enhanced ductility. Meanwhile, the force required to move a dislocation across a grain having intragranular twinning would be considerably greater relative to a grain without twinning. As a result, a greater force would be needed to sustain dislocation migration in the presence of intragranular twinning while at the same time such intragranular twinning may allow for increased ductility.

The amount of shear stress sufficient to form intragranular twins may be described by a critical shear twinning stress, $\tau_{crit}$ as follows:

$$\tau_{crit} = \frac{2\gamma_{SF}}{b}, \quad (2)$$

where b is a burger vector representing the magnitude and direction of the lattice distortion resulting from a dislocation in a crystal lattice. As the critical shear twinning stress will be lower when the stacking fault energy is lower, increasing cobalt concentration in the nickel-cobalt alloy favors intragranular twinning.

Intragranular twins formed during heat treatment may be referred to as annealing twins. The density of annealing twins, ρ may be described in relation to grain size D and a material dependent constant B, which is inversely proportional to stacking fault energy, as follows:

$$\rho = \frac{B}{D}\log\left[\frac{D}{D_O}\right], \quad (3)$$

where Do is the grain size at which ρ is zero. As B is inversely proportional to stacking fault energy, a low stacking fault energy associated with increasing cobalt concentration in the nickel-cobalt alloy also favors formation of annealing twins.

Taken individually or in combination, the presence of phosphorous precipitants pinning grain boundaries of the nickel-cobalt alloy and/or intragranular twinning attributable to the elevated cobalt level in the nickel-cobalt alloy provides for increased thermal stability of the alloy. Thermal stability may be characterized with reference to an onset temperature, $T_{onset}$ for grain growth in the nickel-cobalt alloy. Typically, the onset temperature for grain growth in a nickel-cobalt alloy corresponds to about 40% of the melting temperature, $T_{melt}$ for the alloy. However, the introduction of phosphorous precipitants and/or an elevated level of cobalt may increase the onset temperature through pinning and/or intragranular twinning, respectively. In some embodiments, the onset temperature, $T_{onset}$ for grain growth in a nickel-cobalt alloy may be increased to about 50% or even about 60% of the melting temperature, $T_{melt}$ for the alloy.

Figure 5:
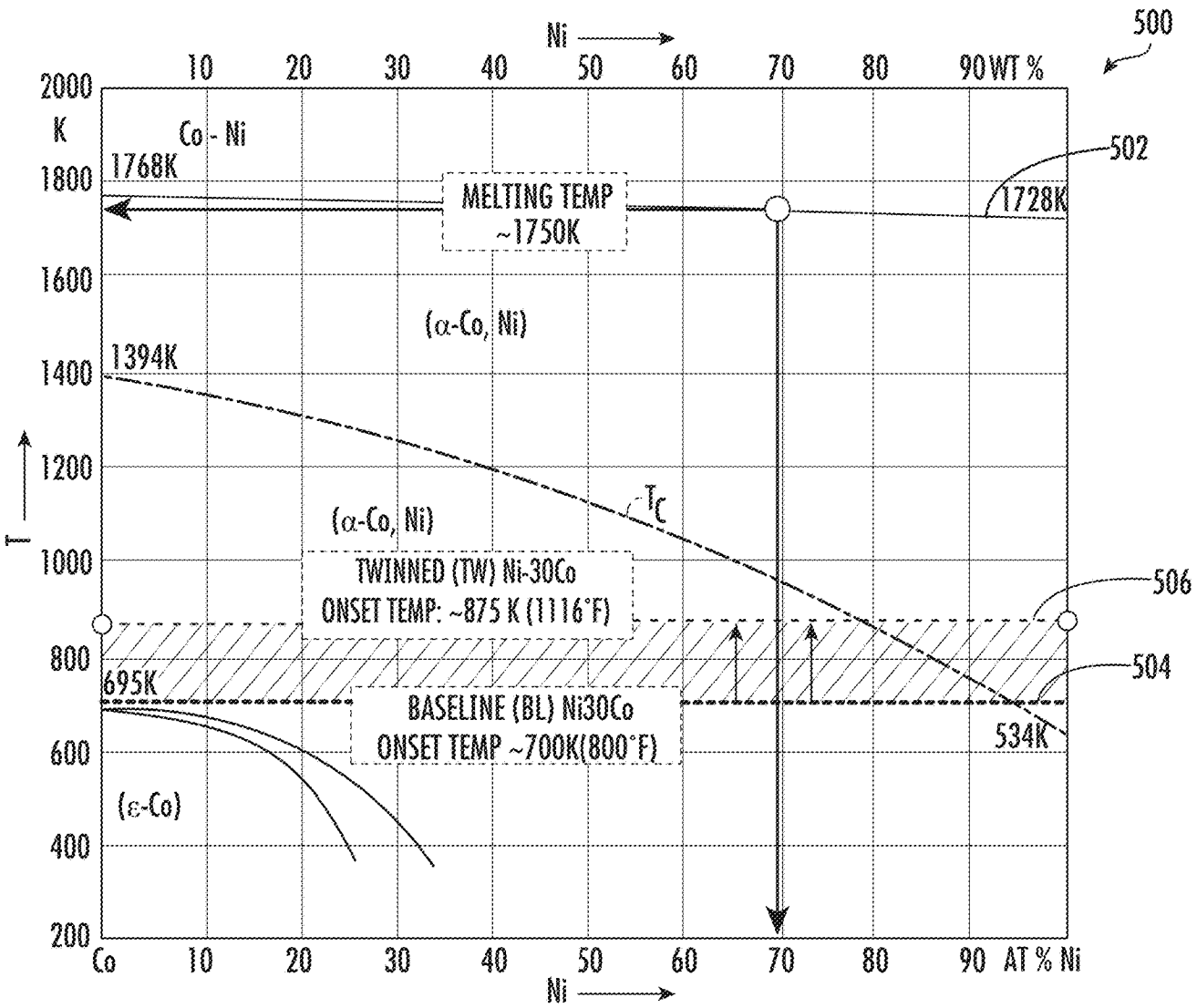
FIG. 5 shows a phase diagram for a nickel-cobalt alloy with an exemplary onset temperature for grain growth superimposed thereon.

FIG. 5 shows a phase diagram 500 for nickel-cobalt alloys, with onset temperatures superimposed thereon. By way of example, a phosphorous-doped nickel-cobalt alloy with 30% cobalt, the melting temperature, $T_{melt}$ 502 is about 1750K (about 1476.9° C.). A baseline onset temperature, $T_{onset}$ 504 for grain growth in such nickel-cobalt alloy at 40% of the melting temperature would be about 700K. However, an increase in the onset temperature, $T_{onset}$ to 50% of the melting temperature would correspond to an onset temperature 506 for grain growth of about 875K. Likewise, an increase in the onset temperature, $T_{onset}$ to 60% of the melting temperature would correspond to an onset temperature for grain growth of about 1050K. Of course, the onset temperature may vary depending on the composition of the material and the heat treatment schedule performed upon the material. The improved thermal stability corresponding to such an increase in onset temperature for grain growth may allow for components formed of the presently disclosed nickel-cobalt alloy to operate at higher temperatures and/or for such components to have a longer service life. Additionally, or in the alternative, components may be formed of the presently disclosed nickel-cobalt alloy having a thinner cross-section and corresponding lighter weight while still maintaining thermal stability.

Figure 6:
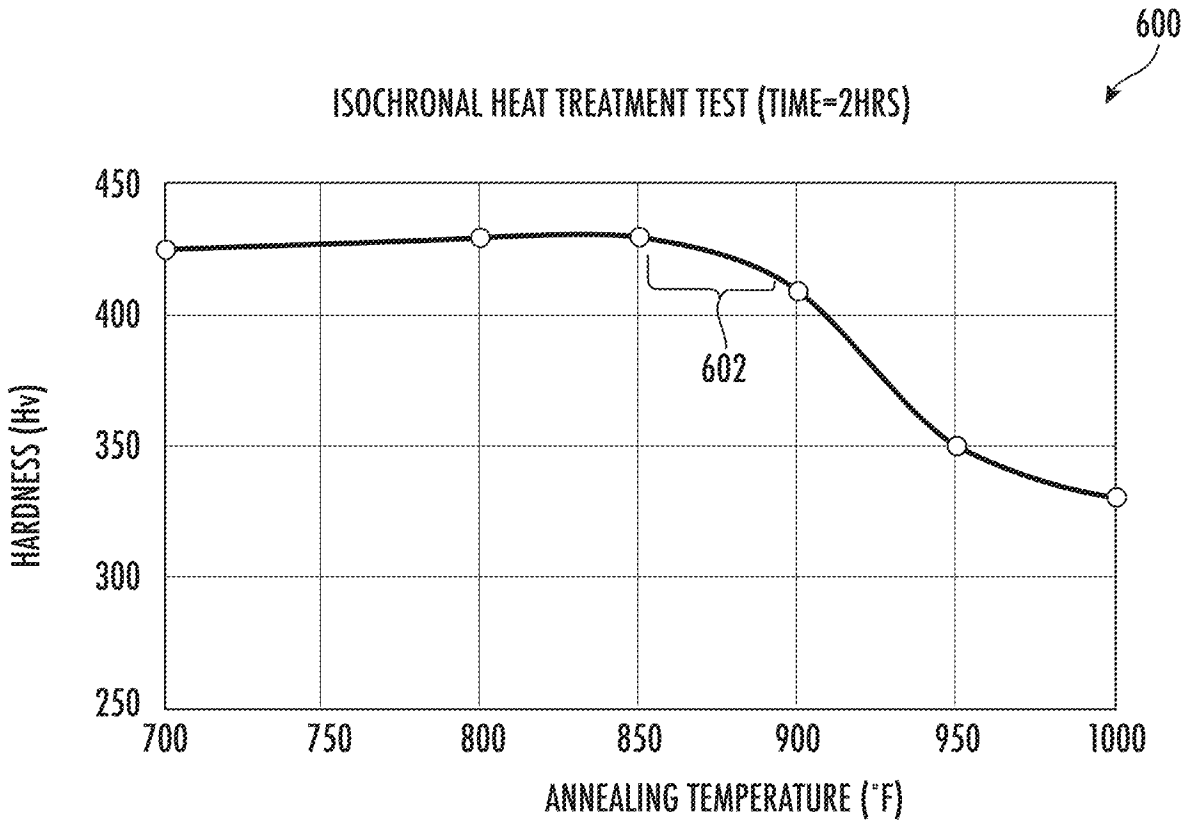
FIG. 6 shows a plot of hardness vs. annealing temperature corresponding to an exemplary isochronal heat treatment study.

The onset temperature $T_{onset}$ for grain growth in a particular alloy may be determined by performing an isochronal heat treatment study, whereby samples are exposed to an isochronal heat treatment at different temperatures and then indirectly tested for grain growth via hardness, strength, or other measurement. An initial decrease in hardness indicates onset of grain growth. As shown in FIG. 6, an exemplary plot of hardness vs. heat treatment temperature 600 shows an initial decrease in hardness 602 between about 850° F. and about 900° F. (between about 454.4° C. and 482.2° C.).

While grain growth may reduce tensile strength, grain growth does advantageously increase ductility. As such, some embodiments of the presently disclosed nickel-cobalt alloy may include a multi-modal composite matrix of grain structures having various regions with different grain size distributions. Additionally, while amorphous regions may have low ductility, amorphous regions advantageously have a high tensile strength. As such, some embodiments of the presently disclosed nickel-cobalt alloy may include a multi-modal composite matrix of amorphous regions and crystalline regions. In some embodiments, a multi-modal composite matrix may include a combination of amorphous regions and crystalline regions, with the crystalline regions including ultrafine nanocrystalline regions, nanocrystalline regions, or coarse grain regions, or a combination of such regions.

Figure 7:
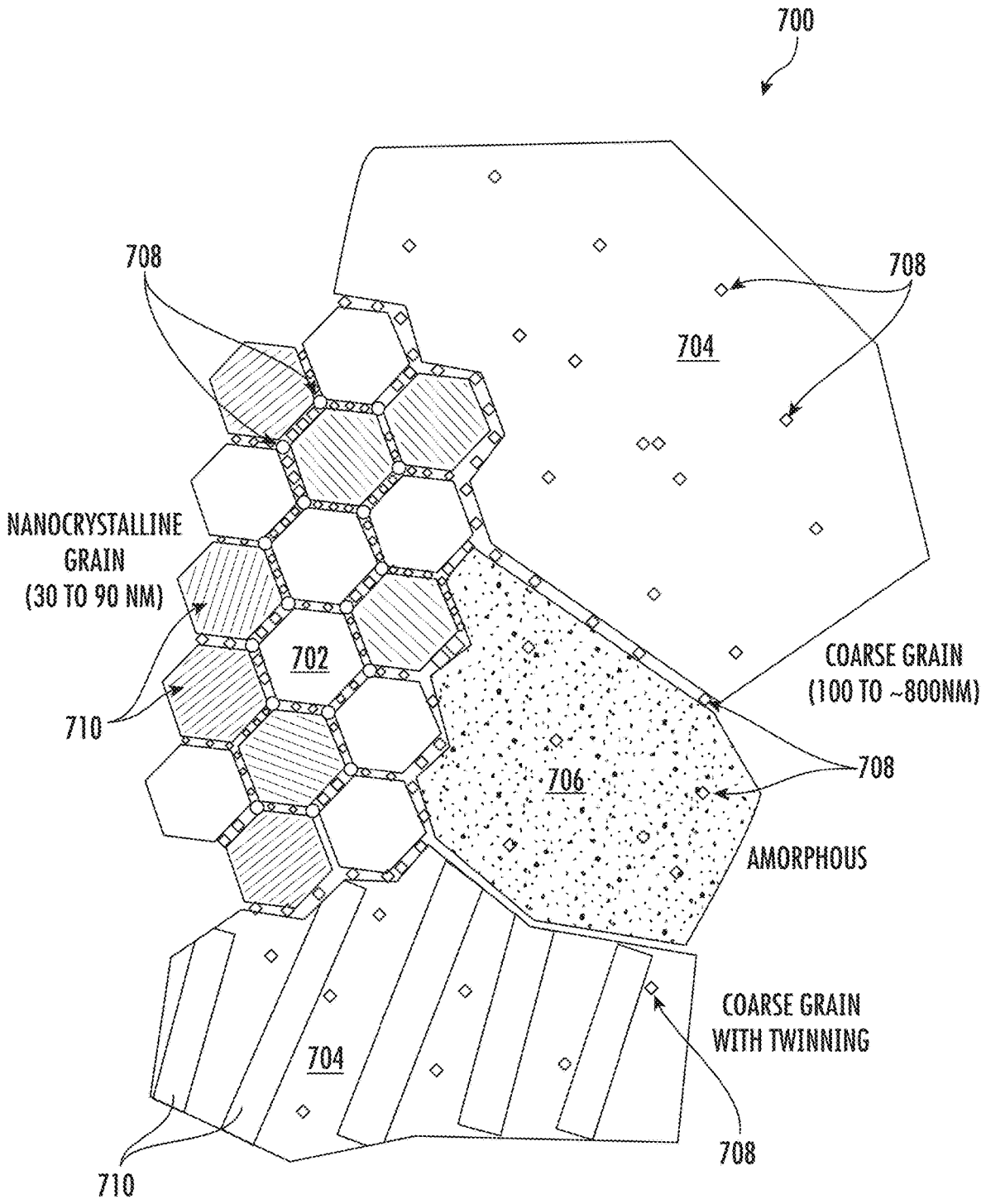
FIG. 7 shows a schematic illustration of an exemplary multi-modal composite matrix.

FIG. 7 shows a schematic illustration of an exemplary multi-modal composite matrix 700 for the presently disclosed nickel-cobalt alloy which may be formed from a precursor material by performing the presently disclosed heat treatment methods. The multi-modal composite matrix 700 includes a nanocrystalline grain regions 702, coarse grain regions 704, and amorphous regions 706, which may be distributed heterogeneously or homogeneously. Phosphorous precipitates 708 may be present throughout the multi-modal composite matrix. The phosphorous precipitates 708 may be located at grain boundaries, providing pinning that inhibits further grain growth. Phosphorous precipitates 708 may also be located within the nanocrystalline grains, the coarse grains, and/or the amorphous metal. The phosphorous precipitates located within the grains or amorphous metal may provide a pinning force that resists movement of dislocations and or other grain boundaries from propagating therethrough. Intragranular twins 710 may be present in at least some of the nanocrystalline grain regions 702. Additionally, intragranular twins 710 may be present in at least some of the coarse grain regions 704. The phosphorous precipitates 708 and/or the intragranular twins 710 may provide added strength and/or ductility. Additionally, the combination of nanocrystalline grain regions 702, coarse grain regions 704, and amorphous regions 706 may work synergistically to provide a multi-modal composite matrix that has good strength and ductility.

An exemplary nickel-cobalt material may include from about 40% to 90% by atomic weight nickel, from about 10% to about 60% by weight cobalt, from about 100 ppm to 20,000 ppm by weight phosphorous, and less than 1% by weight of impurities. In some embodiments, an exemplary nickel-cobalt material may include less than 250 ppm sulfur by weight.

The concentration of nickel in the nickel-cobalt alloy may be from about 40% to about 90% by weight, such as from about 50% to about 80% by weight, such as from about 60% to about 70% by weight, such as from about 55% to about 65% by weight, or such as from about 65% to about 75% by weight. The concentration of nickel in the nickel-cobalt alloy may be at least about 40% by weight, such as at least about 50% by weight, such as at least about 60% by weight, such as at least about 70% by weight, or such as at least about 80% by weight. The concentration of nickel in the nickel-cobalt alloy may be less than about 90% by weight, such as less than about 80% by weight, such as less than about 755 by weight, such as less than about 70% by weight, such as less than about 60% by weight, or such as less than about 50% by weight.

The concentration of cobalt in the nickel-cobalt alloy may be from about 10% to about 60% by weight, such as from about 20% to about 50% by weight, such as from about 26% to about 48% by weight, such as from about 28% to about 42% by weight, such as from about 25% to about 45% by weight, such as from about 28% to about 36% by weight, such as from about 24% to about 42% by weight, such as from about 28% to about 36% by weight, or such as from about 32% to about 46% by weight. The concentration of cobalt in the nickel-cobalt alloy may be at least about 10% by weight, such as at least about 20% by weight, such as at least about 24% by weight, such as at least about 25% by weight, such as at least about 26% by weight, such as at least about 28% by weight, such as at least about 32% by weight, such as at least about 36% by weight, such as at least about 38% by weight, such as at least about 40% by weight, such as at least about 42% by weight, such as at least about 44% by weight, such as at least about 46% by weight, such as at least about 48% by weight, or such as at least about 50% by weight. The concentration of nickel in the nickel-cobalt alloy may be less than about 60% by weight, such as less than about 50% by weight, or such as less than about 40% by weight.

The concentration of the phosphorous in the nickel-cobalt alloy may be from about 100 ppm to about 20,000 ppm by weight, such as from about 100 ppm to about 15,000 ppm, such as from about 100 ppm to about 10,000 ppm, such as from about 100 ppm to about 5,000 ppm, such as from about 500 ppm to about 3,500 ppm, such as from 100 ppm to about 2,000 ppm, such as from about 1,000 ppm to about 2,500 ppm, such as from about 1,000 ppm to about 1,600 ppm, or such as from about 1,200 to about 1,400 ppm by weight. The concentration of the phosphorous in the nickel-cobalt alloy may be at least about 100 ppm by weight, such as at least about 200 ppm, such as at least about 400 ppm, such as at least about 600 ppm, such as at least about 800 ppm, such as at least about 1,000 ppm, such as at least about 1,200 ppm, such as at least about 1,400 ppm, such as at least about 1,600 ppm, such as at least about 1,800 ppm, such as at least about 2,000 ppm, such as at least about 4,000 ppm, such as at least about 6,000 ppm, such as at least about 10,000 ppm, or such as at least about 15,000 ppm by weight. The concentration of the phosphorous in the nickel-cobalt alloy may be less than about 15,000 ppm by weight, such as less than about 10,000 ppm, such as less than about 6,000 ppm, such as less than about 4,000 ppm, such as less than about 2,000 ppm, such as less than about 1,800 ppm, such as less than about 1,600 ppm, such as less than about 1,400 ppm, such as less than about 1,200 ppm, or such as less than about 1,000 ppm by weight.

The concentration of the sulfur in the nickel-cobalt alloy may be less than about 250 ppm by weight, such as less than about 200 ppm, such as less than about 175 ppm, such as less than about 150 ppm, such as less than about 125 ppm, such as less than about 100 ppm, such as less than about 75 ppm by weight.

Nickel-cobalt materials may be formed by producing a precursor metal matrix composite material using an electrodeposition process, and then heat treating the precursor material. A precursor nickel-cobalt material may be formed using any suitable electrodeposition process, such as a Watts bath. The electrodeposition process may be carried out using an electrodeposition bath that contains a nickel source, a cobalt source, and a dopant source (e.g., a phosphorous source). The electrodeposition bath may additionally include boric acid or a salt thereof to prevent electrode surface passivation or nickel reduction and to act as a surface agent, one or more chelating agents and/or complexing agents for chelating or complexing particular ions in the electrodeposition bath.

The nickel source for the electrodeposition bath may include nickel sulfate, nickel hypophosphite, nickel oxide, nickel carbonate, or nickel chloride, as well as combinations of these. Preferably, the nickel source includes nickel sulfate. The nickel source may be provided at an ion concentration of from about 50 to mM to about 1 M, such as from about 250 mM to about 750 mM.

The cobalt source for the electrodeposition bath may include cobalt sulfate, cobalt chloride, or a cobalt carbonate, as well as combinations of these. Preferably, the cobalt source includes cobalt sulfate. The cobalt source may be provided at an ion concentration of from about 10 to mM to about 100 mM, such as from about 25 mM to about 75 mM.

The dopant source may include a phosphorous source. The phosphorous source for the electrodeposition bath may include hypophosphorous acid and/or a hypophosphite salt. Exemplary hypophosphite salts include sodium hypophosphite, potassium hypophosphite, nickel hypophosphite, or ammonium hypophosphite, or other hypophosphite salts of alkali or alkaline earth metals, as well as combinations of these. Preferably, the phosphorous source includes sodium hypophosphite. The phosphorous source may be provided at an ion concentration of from about 50 to mM to about 500 mM, such as from about 100 mM to about 250 mM.

One or more chelating agents and/or complexing agents may be included in the electrodeposition bath. Exemplary chelating agents include malonic acid, oxalic acid, succinic acid, citric acid, malic acid, maleic acid, tartaric acid, ethylenediamine, ethylenediamine tetraacetic acid (EDTA), triethylene tetraamine, diethylene triamine, hydrazobenzene, amino acids, as well as salts of any of the foregoing. Exemplary complexing agents include acetic acid, propionic acid, glycolic acid, formic acid, lactic acid, glycine, as well as salts of any of the foregoing. Salt forms of chelating agents and/or complexing agents may include alkali or alkaline earth metal salts, ammonium salts, nickel salts, and cobalt salts. Preferably, the electrodeposition bath includes at least one chelating agent and at least one complexing agent. One or more chelating agents may be provided at a concentration of from about 10 mM to about 250 mM, such as from about 25 mM to about 200 mM. One or more complexing agents may be provided at a concentration of from about 100 mM to about 750 mM, such as from about 250 mM to about 500 mM.

The electrodeposition bath may further include various other additives at concentrations of less than 5% by weight, such as less than 2.5% by weight, or such as less than 1% by weight, including, carriers, grain refiners, grain inhibitors, buffering agents, wetting agents, brighteners, surfactants, and so forth. For example, the electrodeposition bath may additionally include an organic grain refining additive selected to reduce the internal stress of deposits, to refine the grain structure, and/or to improve deposit quality. Exemplary grain refining additives may include saccharin (e.g., sodium saccharin, benzoic sulfimide), benzene sulfonic acid, 1,3,6-naphthalene sulfonic acid, allyl sulfonic acid, a combination of saccharin and allyl sulfonic acid, sodium citrate (e.g., monosodium citrate, disodium citrate, and/or trisodium citrate), toluene, a combination of saccharin and sodium citrate, 2-butin-1,4-diol, a combination of saccharin and 2-butin-1,4-diol, pyridinium hydroxyl propyl sulphobetaine (PPSOH), a combination of 2-butin-1,4-diol and PPSOH, sodium methanesulfonate, octane-1-sulfonic acid, polyethylene glycol, polyalkene glycol, a quaternary ammonium (e.g., a quaternary ammonium sulfate), a salt of any of the foregoing (e.g., an alkali or alkaline earth metal salt, an ammonium salt, a sodium salt, a nickel salt, and/or a cobalt salt), as well as combinations of these.

Such an organic grain refining additive may be included in the electrodeposition at a concentration of about 0.001 to about 0.005M, such as from about 0.001 to about 0.004M, or such as from about 0.002 to about 0.003M. For example, a grain refining additive may be included at a concentration from about 1 to about 25 g/L, such as from about 5 to about 20 g/L, such as from about 5 to about 15 g/L. Such organic grain refining additive may include sulfur impurities, however, preferably the resulting electrodeposited material may include a concentration of such sulfur impurities in an amount of less than 250 ppm by weight.

As another example, the electrodeposition bath may include one or more surfactants to reduce the tendency for pitting. Exemplary surfactants for the electrodeposition bath include octylphenol ethoxylates, octylphenoxypolyethoxyethanol, sodium dodecyl sulfate (SDS), sodium lauryl sulfonate (SLS), and so forth. One or more surfactants may be provided at a concentration from about 10 to about 1,000 ppm by weight.

A bath solution may be prepared by combining the various components in an aqueous carrier. Typically, the bath solution may be maintained at an acidic pH of about 3.3 to 4.3, such as about 3.5 to 4.0 using a suitable acidic agent (e.g., hypophosphorous acid, ortho-phosphorous acid, or sulfuric acid) and a suitable basic agent (e.g., sodium hydroxide). The electrodeposition bath includes one or more anodes, such as soluble anodes that release nickel ions and/or cobalt ions into the electrodeposition bath. Suitable soluble anodes include those made of nickel, cobalt, or a nickel-cobalt alloy. Additionally, the electrodeposition bath includes one or more cathodes, and the one or more cathodes may serve as a mandrel that defines a shape of the precursor material deposited thereon. The mandrel may include a conductive coating that allows the precursor material to be easily separated therefrom.

The electrodeposition process may be conducted at a bath temperature of less than about 60° C., such as from about 35° C. to 55° C., or such as from about 40° C. to 50° C. A wide range of current densities may be utilized, including a modulating current density. An average current density may range from about 0 to 600 mA/cm$^2$, such as from 5 to 500 mA/cm$^2$, such as from 50 to 250 mA/cm$^2$, such as from 100 to 200 mA/cm$^2$, such as from 50 to 100 mA/cm$^2$, such as from 25 to 75 mA/cm$^2$, such as from 5 to 50 mA/cm$^2$, or such as from 10 to 30 mA/cm$^2$. The deposition rate may range from about 0.01 mm/hr to about 1 mm/hr, such as from 0.1 to 0.5 mm/hr, with even higher deposition rates being feasible as the presence of cobalt in the nickel-cobalt alloy may sufficiently reduce internal stresses in the precursor material, and also because internal stresses in the precursor material may be relieved during subsequent heat-treating processes.

One or more parameters of the electrodeposition bath may be varied to provide a desired precursor crystalline structure including a combination of amorphous regions and crystalline regions. For example, in some embodiments, pulse plating and/or pulse reverse plating techniques may be utilized to vary the nucleation rate and growth of existing grains, such as by varying peak current density, pulse-on time and pulse-off time. Pulse plating and/or pulse reverse plating may be particularly attractive because it can yield finer grain structures and improved crystalline morphology than that achievable by direct current plating. Other electrodeposition parameters to provide the desired precursor crystalline structure, such as providing a variable bath composition, agitation rate, pH, and so forth.

The electrodeposition conditions including bath chemistry and pulsing parameters may be selected so as to provide a resulting precursor material that has desired structure. In various embodiments, the precursor material may have a multimodal metallic structure including a combination of amorphous regions and crystalline regions, with the crystalline regions made up substantially of nanocrystalline grain structures and/or ultra-fine nanocrystalline grain structures. The proportion of amorphous regions to crystalline regions in the precursor material may be selected so as to achieve the desired thermal stabilization, high strength, and enhanced ductility following heat treatment.

As an example, the electrodeposition process may provide a precursor material substantially in the form of a doped nickel-cobalt metal matrix composite of amorphous metal and ultra-fine nanocrystalline grain material. More particularly, an exemplary electrodeposition process may provide a precursor material substantially in the form of a phosphorous-doped nickel-cobalt metal matrix composite of amorphous metal and ultra-fine nanocrystalline grain material. The nanocrystalline grain material may have a grain size distribution from about 5 nanometers to about 50 nanometers. When subjected to heat treatment as described herein, this precursor material may provide a resulting thermally stabilized metal matrix composite that exhibits relatively high ductility and relatively moderate tensile strength.

As another example, the electrodeposition process may provide a precursor material substantially in the form of a doped nickel-cobalt nanocrystalline grain material, with a grain size distribution from about 20 to 100 nanometers. More particularly, an exemplary electrodeposition process may provide a precursor material substantially in the form of a phosphorous-doped nickel-cobalt nanocrystalline grain material, with a grain size distribution from about 20 to 100 nanometers. When subjected to heat treatment as described herein, this precursor material may provide a resulting thermally stabilized metal matrix composite that exhibits relatively high tensile strength and relatively moderate ductility.

It may be preferable for the crystalline regions of the precursor material to be substantially free of coarse grain structures, though such crystalline regions need not be entirely free of coarse grain structures. For example, in some embodiments, coarse grain structures may be present in the precursor material in an amount of 5% or less by volume, such as 2.5% or less by volume, such as 1% or less by volume, or such as 0.1% or less by volume.

An exemplary electrodeposition process may provide a precursor material having any desired thickness. In some embodiments, panels may be produced that have a thickness of from about 0.01 to 0.375 inches, such as from about 0.01 to about 0.25 inches, such as from about 0.02 inches to about 0.12 inches, such as from about 0.04 inches to about 0.10 inches, such as from about 0.06 inches to about 0.08 inches such as from about 0.02 to 0.20 inches, such as from about 0.01 to about 0.15 inches, such as from about 0.10 to about 0.25 inches, such as from about 0.15 to about 0.25 inches, such as from about 0.05 to about 0.25 inches, such as from about 0.10 to about 0.20 inches, such as from about 0.20 to 0.25 inches, such as from about 0.25 to about 0.30 inches, such as from about 0.30 inches to about 0.35 inches, or such as from about 0.30 inches to about 0.375 inches. The panels may be at least about 0.02 inches thick, such as at least about 0.04 inches thick, such as at least about 0.06 inches thick, such as at least about 0.08 inches thick, such as at least about 0.10 inches thick, such as at least about 0.12 inches thick, such as at least about 0.14 inches thick, such as at least about 0.16 inches thick, such as at least about 0.18 inches thick, such as at least about 0.20 inches thick, such as at least about 0.22 inches thick, or such as at least about 0.24 inches thick.

The precursor material may be subjected to heat treatment using any desired heat treatment system, including, for example, a batch furnace or a continuous furnace. A controlled atmosphere may be provided. The controlled atmosphere may supply one or more gasses to the heat treatment system, optionally under a negative pressure environment. As examples, one or more gases may include hydrogen, nitrogen, argon, ammonia, carbon dioxide, carbon monoxide, helium, hydrocarbons (e.g., methane, ethane, propane, butane, etc.), or steam, as well as combinations of these. The one or more gases may provide an endothermic atmosphere or an exothermic atmosphere. The particular heat treatment time and temperature schedule will depend on the composition of the precursor material and the desired resulting properties following heat treatment.

Additionally, or in the alternative, in some embodiments the precursor material may be subjected to heat treatment in an operating environment, such as an operating environment provided by a turbomachine engine. A component may be formed from a precursor material and the installed in an operating environment where high-heat conditions of the operating environment provide for the heat treatment of the component formed from the precursor material. For example, a component of a turbomachine engine may be formed from a precursor material and installed in the turbomachine engine. The operating environment may inherently or selectively provide a particular heat treatment time and temperature schedule suitable for the composition of the precursor material and the desired resulting properties following heat treatment.

In some embodiments, an operating environment suitable for providing the heat treatment may result from nominal operations, such as nominally operating a turbomachine engine. Additionally, or in the alternative, an operating environment suitable for providing the heat treatment may be selectively provided with operations according to a specified operating schedule selected to provide a particular heat treatment time and/or temperature schedule suitable for the composition of the precursor material and the desired resulting properties following heat treatment. For a component of a turbomachine engine, the specified operating schedule may be provided based at least in part on the location of the component within the turbomachine engine and the corresponding heat exposure of the components resulting from given operating conditions of the turbomachine engine.

In some embodiments, a component formed of a precursor material may be unsuitable for use in an operating environment under nominal operating conditions, but the resulting heat treatment may provide desired strength and ductility properties that allow for suitable use of the component in the operating environment. However, an operating environment suitable for providing the desired heat treatment may be provided by way of a break-in period or a heat treatment period prior to commencing nominal operations. The break-in period or the heat treatment period may be selectively configured to provide a particular heat treatment time and/or temperature schedule suitable for the composition of the precursor material and the desired resulting properties following heat treatment.

Figure 8:
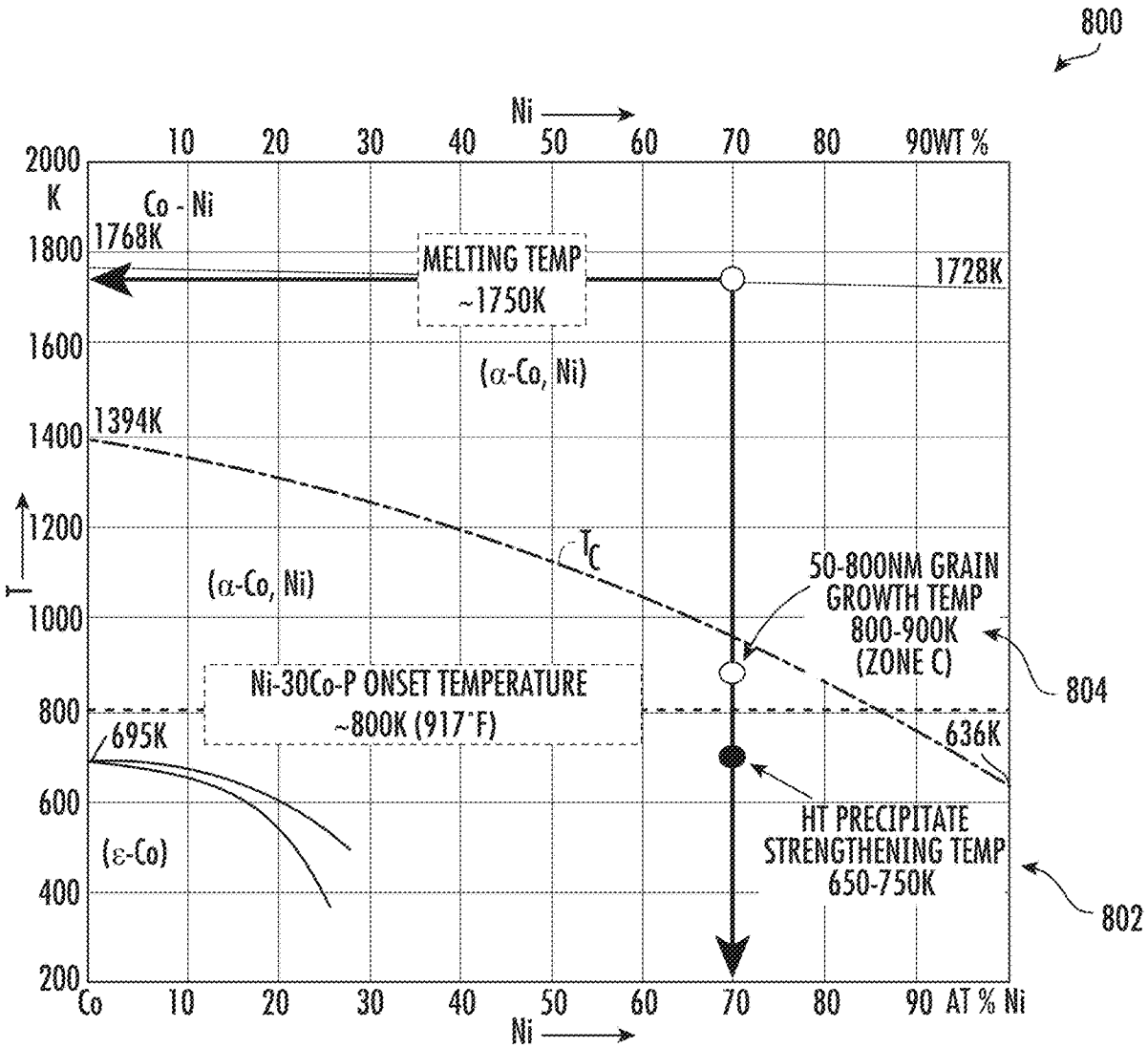
FIG. 8 shows a phase diagram for a nickel-cobalt alloy with exemplary heat treatment zones superimposed thereon.

In some embodiments, a precursor material may be subjected to a first precipitate strengthening heat treatment and/or a second annealing heat treatment. FIG. 8 shows a phase diagram 800 for nickel-cobalt alloys with exemplary heat treatment zones superimposed thereon for the first precipitate strengthening heat treatment 802 and the second annealing heat treatment 804.

A first heat treatment may be performed within temperature zone below the onset temperature for grain growth so as to provide a precipitate strengthening heat treatment. The onset temperature for grain growth in the precursor material may be determined by performing an isochronal heat treatment study for the precursor material as described with reference to FIG. 6. By way of example, as described with reference to FIG. 5, a phosphorous-doped nickel-cobalt alloy with 30% cobalt may have a baseline onset temperature $T_{onset}$ 504 of about 700K (426.9° C.). However, it will be appreciated that the onset temperature for grain growth may vary depending on the composition of the precursor material. The first precipitate strengthening heat treatment provides phosphorous precipitates which cause Zener pinning. The first precipitate strengthening heat treatment may be performed at a constant temperature, or the temperature may vary, such as according to a heat treatment cycle that includes a sequence of heat treatment temperatures.

The time period for the first precipitate strengthening heat treatment may vary. For example, the time period may be selected so as to obtain the desired precipitate strengthening. In some embodiments, the first precipitate strengthening heat treatment may be performed for a period of from 30 minutes to 36 hours, such as from 2 hours to 18 hours, such as at least 30 minutes, such as at least 1 hour, such as at least 2 hours, such as at least 5 hours, such as at least 12 hours, such as at least 13 hours, such as at least 15 hours, such as at least 18 hours, such as at least 24 hours, such as at least 30 hours. Optionally, the material resulting from the first precipitate strengthening heat treatment may be quenched or cooled slowly.

In some embodiments, the first precipitate strengthening heat treatment may include heat treating within a temperature zone from about 600K to about 750K (about 326.9° C. to about 476.9° C.), such as about 650K to about 750K (about 376.9° C. to about 476.9° C.), such as about 625K to about 650K (351.9° C. to about 376.9° C.), such as from about 650K to about 700K (about 376.9° C. to about 426.9° C.), such as from about 700K to about 750K (about 426.9° C. to about 476.9° C.), or such as from about 675K to about 725K (about 401.9° C. to about 451.9° C.). By way of example, an exemplary first precipitate strengthening heat treatment may be performed at about 625K to about 650K (351.9° C. to about 376.9° C.) for at least 13 hours. It will be appreciated that there is a relationship between time and temperature, and various temperatures below the onset temperature for grain growth may be selected in combination with various heat treatment times when providing the first precipitate strengthening heat treatment.

In some embodiments, the first precipitate strengthening heat treatment may be performed within a temperature zone according to a heat treatment cycle that includes one or more increases in temperature above the onset temperature for grain growth for a period of time. For example, with an onset temperature of 700K (426.9° C.), an exemplary first precipitate strengthening heat treatment may include heat treating according to a cycle within a temperature zone from about 650K to about 750K (about 376.9° C. to about 476.9° C.), with a first portion of the cycle carried out within a temperature zone from about 650K to about 700K (about 376.9° C. to about 426.9° C.), and a second portion of the cycle carried out within a temperature zone from about 700K to about 750K (about 426.9° C. to about 476.9° C.).

A second heat treatment may be performed at a temperature above the onset temperature for grain growth so as to provide an annealing heat treatment. The second annealing heat treatment may be performed after the first precipitate strengthening heat treatment or as an alternative to the first precipitate strengthening heat treatment. When the second annealing heat treatment is performed after the first precipitate strengthening heat treatment, the first precipitate strengthening heat treatment may have increased the onset temperature. Thus, the onset temperature for grain growth in the material resulting from the first precipitate strengthening heat treatment may be determined by performing another isochronal heat treatment test as described with reference to FIG. 6.

By way of example, as described with reference to FIG. 5, following the first precipitate strengthening heat treatment, a phosphorous-doped nickel-cobalt alloy with 30% cobalt may have an onset temperature $T_{onset}$ 504 of about 700K to about 800K (about 426.9° C. to about 526.9° C.). Following the first precipitate strengthening heat treatment, such material may have an onset temperature within the range of about 700K to about 900K (about 426.9° C. to about 626.9° C.), such as within the range of about 700K to about 875K (about 426.9° C. to about 601.9° C.), such as within the range of about 750K to about 850K (about 476.9° C. to about 576.9° C.), such as within the range of about 775K to about 825K (about 501.9° C. to about 551.9° C.), such as about 800K (526.9° C.).

The second annealing heat treatment may provide annealing twins and/or controlled grain growth. The second annealing heat treatment may be performed at a constant temperature, or the temperature may vary, such as according to a heat treatment cycle that includes a sequence of heat treatment temperatures. The time period for the second annealing heat treatment may vary. For example, the time period may be selected so as to obtain the desired annealing twins and controlled grain growth. In some embodiments, the second annealing heat treatment may be performed for a period of from 10 minutes to 5 hours, such as from 30 minutes to 3 hours, such as at least 10 minutes, such as at least 20 minutes, such as at least 30 minutes, such as at least 1 hour, such as at least 2 hours. Optionally, the material resulting from the second annealing heat treatment may be quenched or cooled slowly.

In some embodiments, the second annealing heat treatment may include heat treating within a temperature zone from about 800K to about 900K (about 526.9° C. to about 626.9° C.), such as from about 800K to about 850K (about 526.9° C. to about 576.9° C.), such as from about 850K to about 900K (about 576.9° C. to about 626.9° C.), or such as from about 825K to about 875K (about 551.9° C. to about 601.9° C.). In some embodiments, the second annealing heat treatment may be performed within a temperature zone according to a heat treatment cycle that includes one or more increases in temperature above the onset temperature for grain growth for a period of time. For example, with an onset temperature of 850K (576.9° C.), an exemplary second annealing heat treatment may include heat treating according to a cycle within a temperature zone from about 800K to about 900K (about 526.9° C. to about 626.9° C.), with a first portion of the cycle carried out within a temperature zone from about 800K to about 850K (about 526.9° C. to about 576.9° C.), and a second portion of the cycle carried out within a temperature zone from about 850K to about 900K (about 576.9° C. to about 626.9° C.). It will be appreciated that there is a relationship between time and temperature, and various temperatures above the onset temperature for grain growth may be selected in combination with various heat treatment times when providing the second annealing heat treatment.

Figure 9A:
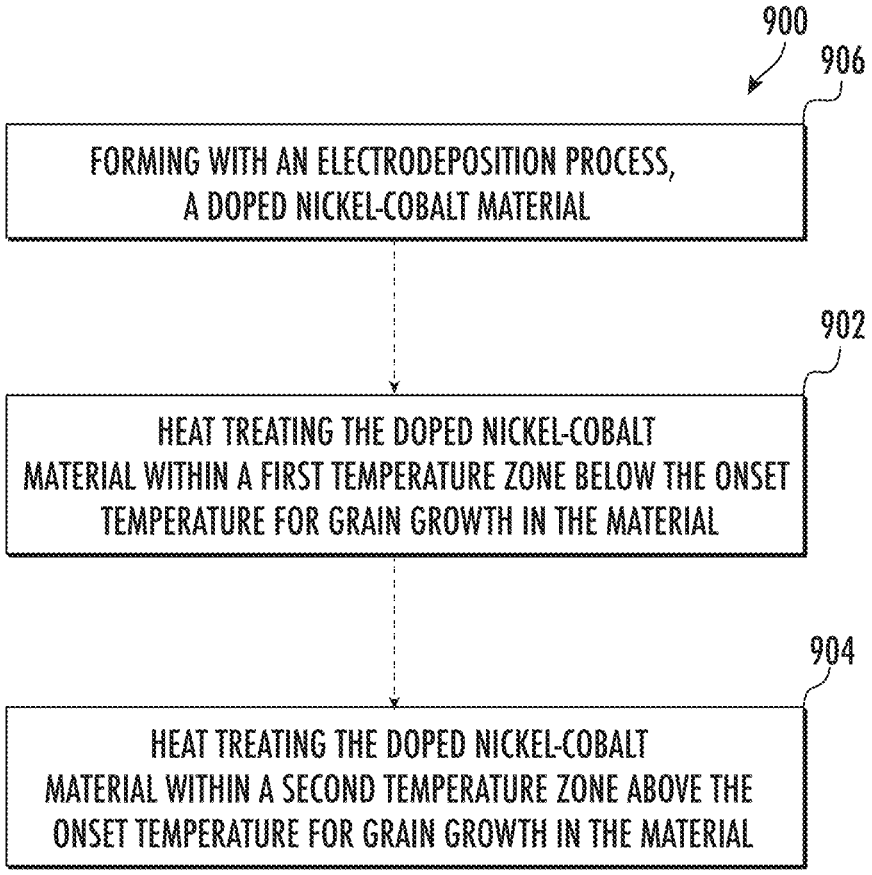
FIGS. 9A-9C are flowcharts depicting exemplary methods of forming and/or thermally stabilizing a nickel-cobalt material.
Figure 9B:
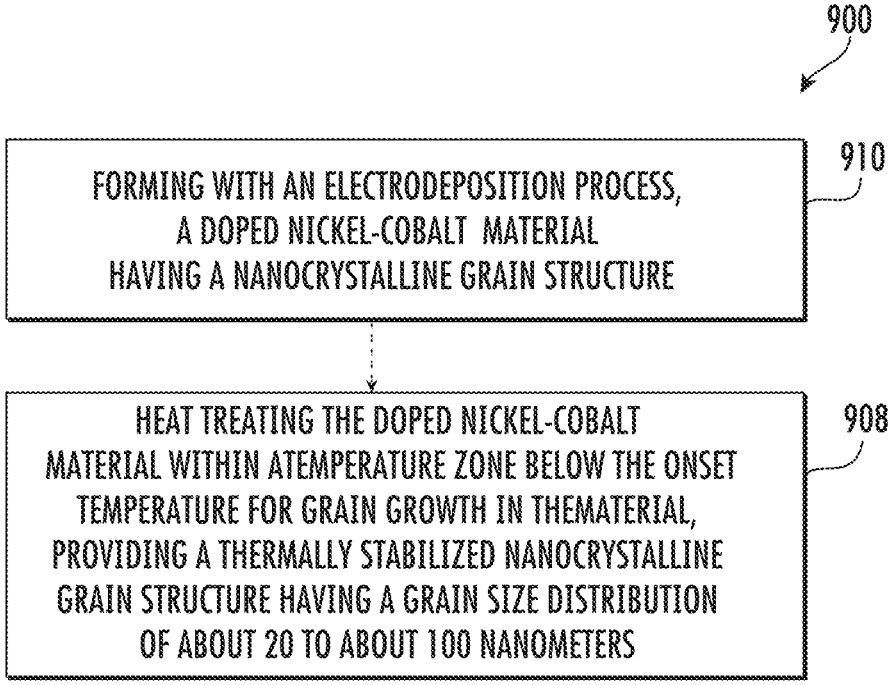
Figure 9C:
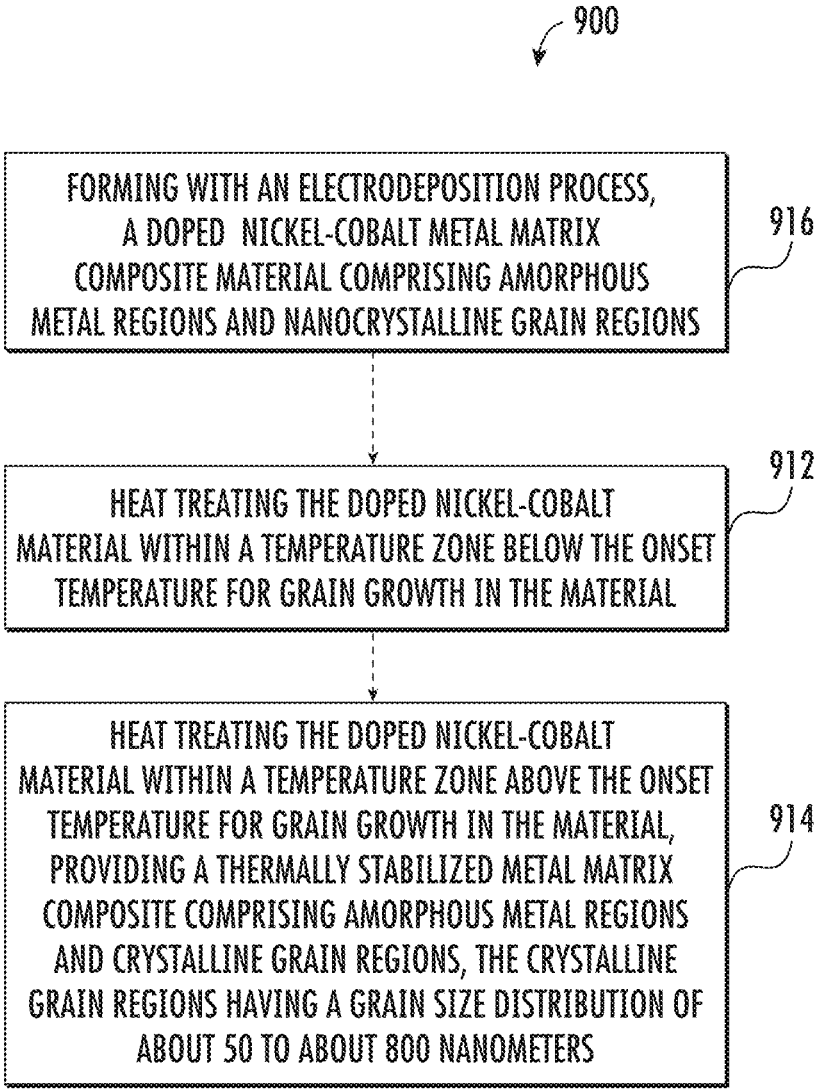

FIGS. 9A-9C show exemplary methods 900 of forming a nickel-cobalt material. As shown in FIG. 9A, an exemplary method 900 includes heat treating a nickel-cobalt material within a first temperature zone below the onset temperature for grain growth in the material 902. The nickel-cobalt material may be a doped nickel-cobalt material, such as a phosphorous-doped nickel-cobalt material, formed using an electrodeposition process. The first temperature zone may be from about 650K to about 750K (about 376.9° C. to about 476.9° C.), such as from about 630K to about 660K (about 356.9° C. to about 386.9° C.). The exemplary method 900 may optionally include heat treating the material within a second temperature zone above the onset temperature for grain growth in the material 904. The second temperature zone may be from about 800K to about 900K (about 526.9° C. to about 626.9° C.). In some embodiments, the method may additionally include forming the doped nickel-cobalt material with an electrodeposition process 906. Exemplary methods 900 may be performed so as to provide a thermally stabilized material with enhanced tensile strength and ductility.

In some embodiments an exemplary method 900 may provide a nickel-cobalt material that exhibits high strength, thermal stability and moderate ductility. A nickel-cobalt material with high strength, thermal stability, and moderate ductility may be obtained by performing a precipitate strengthening heat treatment on a doped nickel-cobalt material, such as a phosphorous-doped nickel-cobalt material, that has a grain size distribution of about 20 to about 100 nanometers. For example, as shown in FIG. 9B, an exemplary method 900 may include heat treating the material within a temperature zone below the onset temperature for grain growth 908. The nickel-cobalt material may include a phosphorous dopant and/or an elevated level of cobalt. The dopant, such as a phosphorous dopant, may be included in the nickel-cobalt material at a concentration of about 1,000 ppm to about 2,500 ppm by weight. The concentration of the cobalt in the nickel-cobalt material may be from about 30% to about 50% by weight. Such a heat treatment may provide a thermally stabilized nanocrystalline grain structure having a grain size distribution of about 20 to about 100 nanometers substantially encompassing the nickel-cobalt material. In some embodiments, the method 900 may additionally include forming the doped nickel-cobalt material having a nanocrystalline grain structure with an electrodeposition process 910.

In some embodiments an exemplary method 900 may provide a nickel-cobalt material with amorphous metal regions and nanocrystalline grain regions. Such a material may exhibit high ductility, thermal stability and moderate strength. A nickel-cobalt material with high ductility, thermal stability and moderate strength may be obtained by performing a precipitate strengthening heat treatment followed by an annealing heat treatment. For example, as shown in FIG. 9C, an exemplary method 900 may include heat treating a nickel-cobalt material within a temperature zone below the onset temperature for grain growth in the material 912, and then heat treating the material within a temperature zone above the onset temperature for grain growth in the material 914. The concentration of the dopant, such as a phosphorous dopant, in the nickel-cobalt material may be about 500 ppm to about 2,500 ppm by weight. The concentration of the cobalt in the nickel-cobalt material being from about 30% to about 50% by weight. The heat treatments may provide a thermally stabilized metal matrix composite with amorphous metal regions and crystalline grain regions that have a grain size distribution of about 50 to about 800 nanometers. The crystalline grain regions may include a composite of nanocrystalline grain regions and coarse grain regions. In some embodiments, the method 900 may include forming the doped nickel-cobalt metal matrix composite material that has amorphous metal regions and nanocrystalline grain regions, using an electrodeposition process 916.

Figure 10:
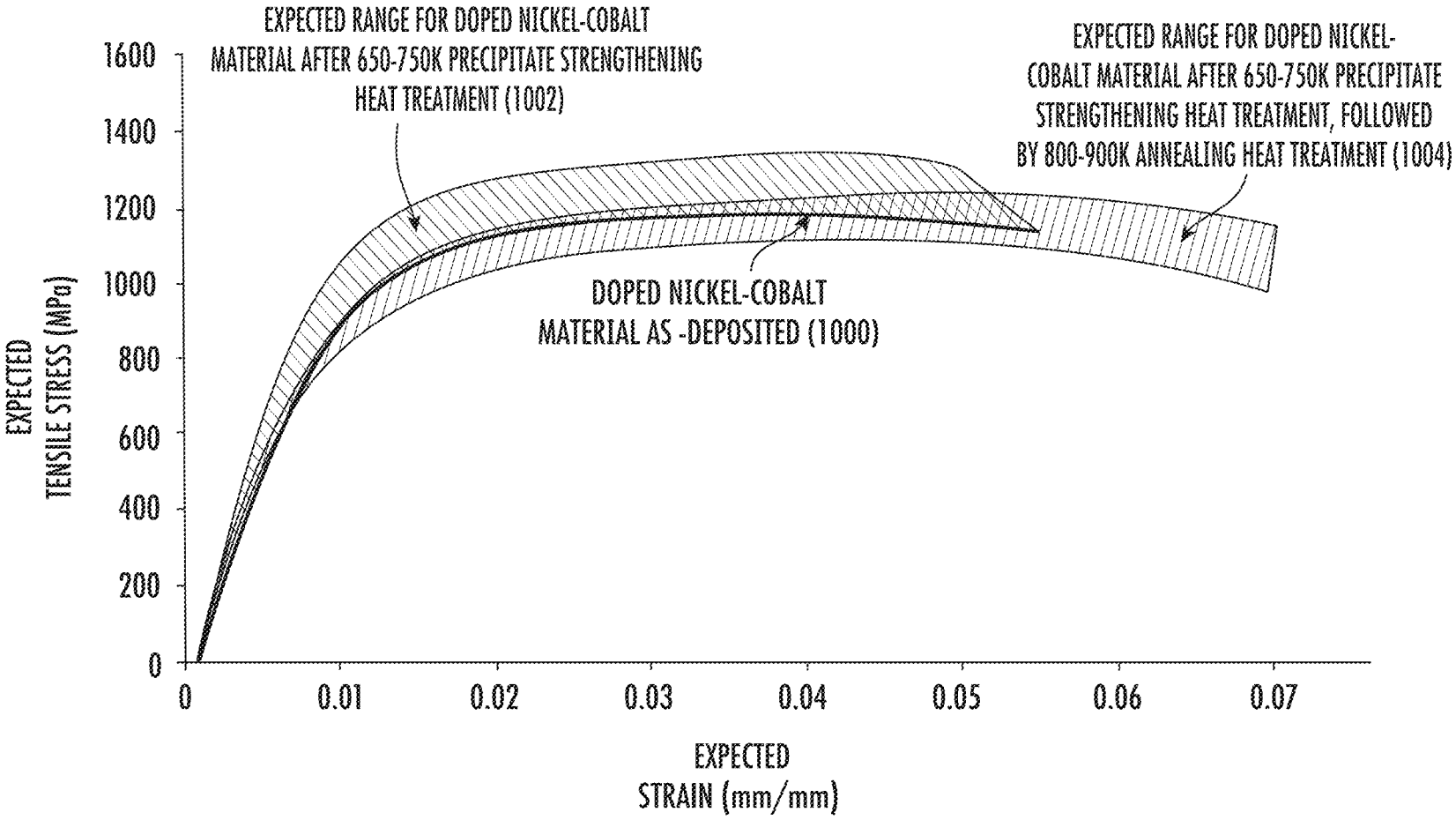
FIG. 10 shows a stress-strain curve for an exemplary nickel-cobalt material illustrating the effects of precipitate strengthening and annealing heat treatments on strength and ductility.
Figure 11:
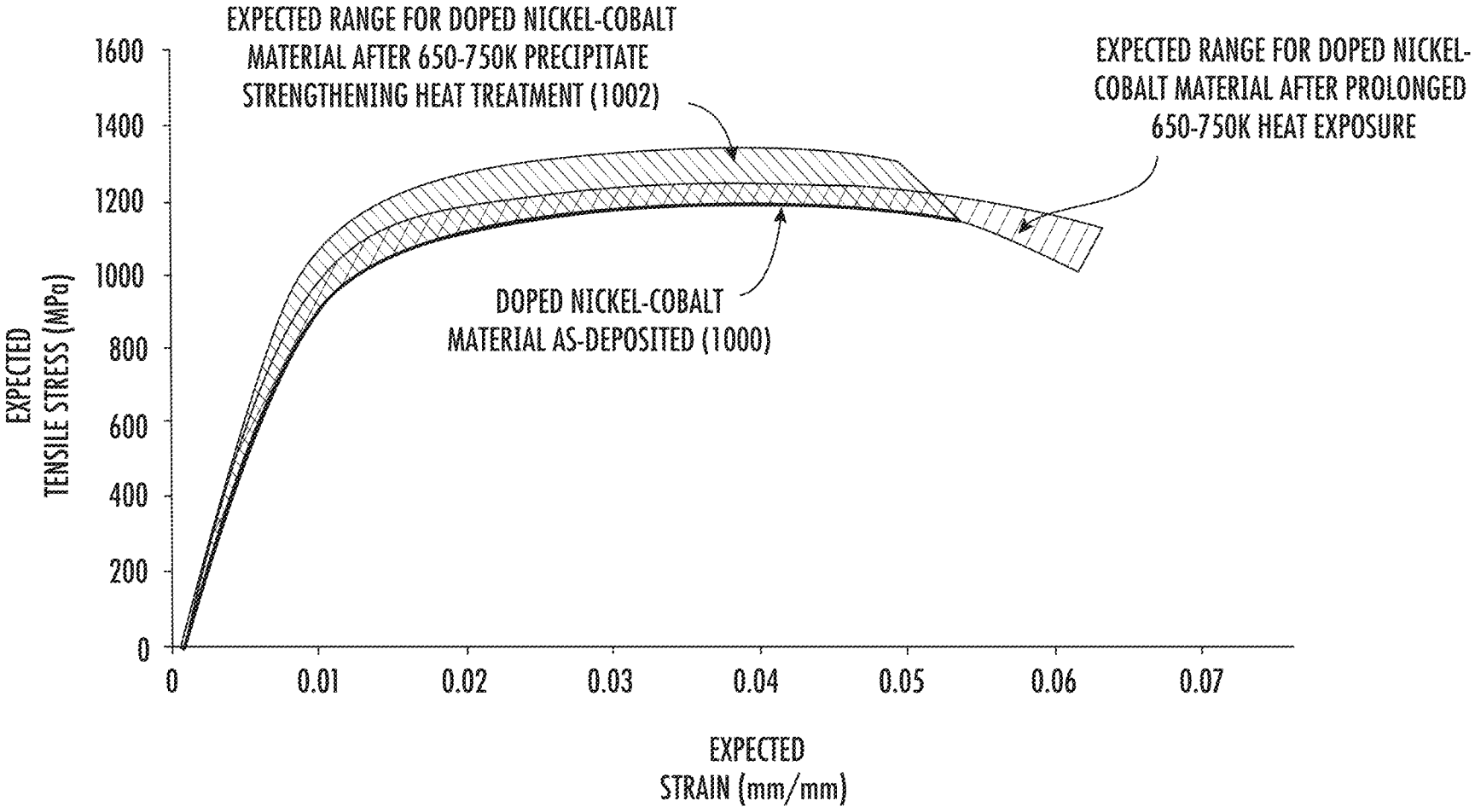
FIG. 11 shows a stress-strain curve for an exemplary nickel-cobalt material illustrating the effects of aging heat treatments on strength and ductility.

Now, referring to FIGS. 10 and 11, expected stress-strain curves for doped nickel-cobalt materials will be described. As shown in FIG. 10, an exemplary doped nickel-cobalt material, such as a phosphorous-doped nickel-cobalt material, may exhibit an as-deposited stress-strain curve 1000. The as-deposited material may be subjected to a precipitate strengthening heat treatment (e.g., about 650K to about 750K (about 376.9° C. to about 476.9° C.)). The precipitate strengthening heat treatment and/or the annealing heat treatment may be performed in accordance with the present disclosure. After a precipitate strengthening heat treatment, the exemplary doped nickel-cobalt material would be expected to exhibit a precipitate strengthened stress-strain curve, which may fall within an expected precipitate strengthening stress-strain range 1002. As indicated, the precipitate strengthening heat treatment would be expected to provide a resulting material that exhibits an improved tensile strength with a somewhat lower ductility relative to the as-deposited material.

In some embodiments, after the precipitate strengthening heat treatment, the material may be subjected to an annealing heat treatment (e.g., about 800K to about 900K (about 526.9° C. to about 626.9° C.). After the annealing heat treatment, the exemplary doped nickel-cobalt material would be expected to exhibit an annealed stress-strain curve, which may fall within an expected annealed stress-strain range 1004. As indicated, a precipitate strengthening heat treatment followed by an annealing heat treatment would be expected to provide a resulting material that exhibits an improved ductility relative to both the as-deposited material and the material after the precipitate strengthening heat treatment. The annealing heat treatment would be expected to reduce tensile strength somewhat relative to the precipitate strengthened stress-strain range 1002. However, good tensile strength would be expected to be preserved because of pinning and/or intragranular twinning, and in some embodiments the annealed stress-strain range 1004 may overlap the as-deposited stress-strain curve 1000 and/or the precipitate strengthened stress-strain range 1002.

The presently disclosed doped nickel-cobalt materials, such as phosphorous-doped nickel-cobalt materials, may exhibit an enhanced tensile strength and/or ductility after heat treatment in accordance with the present disclosure. Exemplary doped nickel-cobalt materials, such as phosphorous-doped nickel-cobalt materials, may exhibit an ultimate tensile strength after heat treatment in accordance with the present disclosure of from about 1,000 MPa to about 1,500 MPa, such as from about 1,100 MPa to about 1,400 MPa, such as from about 1,200 MPa to about 1,375 MPa, such as from about 1,175 MPa to about 1,325 MPa, or such as from about 1,250 MPa to about 1,450 MPa. Exemplary doped nickel-cobalt materials, such as phosphorous-doped nickel-cobalt materials, may exhibit an ultimate tensile strength after heat treatment in accordance with the present disclosure of at least about 1,000 MPa, such as at least about 1,100 MPa, such as at least about 1,200 MPa, such as at least about 1,300 MPa, or such as at least about 1,400 MPa. Exemplary doped nickel-cobalt materials, such as phosphorous-doped nickel-cobalt materials, may exhibit an ultimate tensile strength after heat treatment in accordance with the present disclosure of less than about 1,500 MPa, such as less than about 1,400 MPa, such as less than about 1,300 MPa, or such as less than about 1,200 MPa.

Exemplary doped nickel-cobalt materials, such as phosphorous-doped nickel-cobalt materials, may exhibit a tensile yield strength after heat treatment in accordance with the present disclosure of from about 600 MPa to about 1,400 MPa, such as from about 800 MPa to about 1,200 MPa, such as from about 900 MPa to about 1,300 MPa, such as from about 1,000 MPa to about 1,200 MPa, or such as from about 850 MPa to about 1,150 MPa. Exemplary doped nickel-cobalt materials, such as phosphorous-doped nickel-cobalt materials, may exhibit a tensile yield strength after heat treatment in accordance with the present disclosure of at least about 600 MPa, such as at least about 700 MPa, such as at least about 800 MPa, such as at least about 900 MPa, such as at least about 1,000 MPa, such as at least about 1,100 MPa, such as at least about 1,200 MPa, such as at least about 1,300 MPa, or such as at least about 1,400 MPa. Exemplary doped nickel-cobalt materials, such as phosphorous-doped nickel-cobalt materials, may exhibit a tensile yield strength after heat treatment in accordance with the present disclosure of less than about 1,400 MPa, such as less than about 1,300 MPa, such as less than about 1,200 MPa, such as less than about 1,100 MPa, such as less than about 1,000 MPa, such as less than about 900 MPa, such as less than about 800 MPa, or such as less than about 700 MPa.

Exemplary doped nickel-cobalt materials, such as phosphorous-doped nickel-cobalt materials, may exhibit an elongation strain after heat treatment in accordance with the present disclosure of from about 0.04 mm/mm to about 0.1 mm/mm, such as from about 0.05 mm/mm to about 0.08 mm/mm, such as from about 0.04 mm/mm to about 0.07 mm/mm, such as from about 0.04 mm/mm to about 0.06 mm/mm, such as from about 0.05 mm/mm to about 0.08 mm/mm, such as from about 0.05 mm/mm to about 0.07 mm/mm, such as from about 0.06 mm/mm to about 0.08 mm/mm, such as from about 0.07 mm/mm to about 0.1 mm/mm, or such as from about 0.08 mm/mm to about 0.1 mm/mm. Exemplary doped nickel-cobalt materials, such as phosphorous-doped nickel-cobalt materials, may exhibit an elongation strain after heat treatment in accordance with the present disclosure of at least about 0.04 mm/mm, such as at least about 0.05 mm/mm, such as at least about 0.06 mm/mm, such as at least about 0.07 mm/mm, such as at least about 0.08 mm/mm, or such as at least about 0.09 mm/mm.

Exemplary doped nickel-cobalt materials, such as phosphorous-doped nickel-cobalt materials, may exhibit an elongation strain after heat treatment in accordance with the present disclosure of less than about 0.1 mm/mm, such as less than about 0.09 mm/mm, such as less than about 0.08 mm/mm, such as less than about 0.07 mm/mm, such as less than about 0.06 mm/mm.

Exemplary doped nickel-cobalt materials, such as phosphorous-doped nickel-cobalt materials, may also exhibit an enhanced tensile strength at high temperature. For example, exemplary doped nickel-cobalt materials, such as phosphorous-doped nickel-cobalt materials, may exhibit an ultimate tensile strength at 650° F. (343.3° C.) of from about 1,000 MPa to about 1,500 MPa, such as from about 1,100 MPa to about 1,400 MPa, such as from about 1,200 MPa to about 1,375 MPa, such as from about 1,175 MPa to about 1,325 MPa, or such as from about 1,250 MPa to about 1,450 MPa. Exemplary doped nickel-cobalt materials, such as phosphorous-doped nickel-cobalt materials, may exhibit an ultimate tensile strength at 650° F. (343.3° C.) of at least about 1,000 MPa, such as at least about 1,100 MPa, such as at least about 1,200 MPa, such as at least about 1,300 MPa, or such as at least about 1,400 MPa. Exemplary doped nickel-cobalt materials, such as phosphorous-doped nickel-cobalt materials, may exhibit an ultimate tensile strength at 650° F. (343.3° C.) of less than about 1,500 MPa, such as less than about 1,400 MPa, such as less than about 1,300 MPa, or such as less than about 1,200 MPa.

Exemplary doped nickel-cobalt materials, such as phosphorous-doped nickel-cobalt materials, may exhibit an enhanced percent elongation after heat treatment in accordance with the present disclosure. For example, exemplary doped nickel-cobalt materials, such as phosphorous-doped nickel-cobalt materials, may exhibit an elongation of from about 2% to about 10%, such as from about 3% to about 7%, or such as from about 4% to about 6%. Exemplary doped nickel-cobalt materials, such as phosphorous-doped nickel-cobalt materials, may exhibit an elongation of at least about 2%, such as at least about 4%, such as at least about 5%, such as at least about 6%, such as at least about 7%, or such as at least about 8%. Exemplary doped nickel-cobalt materials, such as phosphorous-doped nickel-cobalt materials, may exhibit an elongation of less than about 8%, such as less than about 7%, or such as less than about 6%.

Exemplary doped nickel-cobalt materials, such as phosphorous-doped nickel-cobalt materials, may exhibit an enhanced hardness after heat treatment in accordance with the present disclosure. For example, exemplary doped nickel-cobalt materials, such as phosphorous-doped nickel-cobalt materials, may exhibit a hardness of from about 350 to about 500 Hv, such as from about 365 to about 485 Hv, such as from about 375 to about 475 Hv, such as from about 385 to about 465 Hv, or such as from about 395 to about 455 Hv. Exemplary doped nickel-cobalt materials, such as phosphorous-doped nickel-cobalt materials, may exhibit a hardness of at least about 350 Hv, such as at least about 375 Hv, such as at least about 400 Hv, such as at least about 425 Hv, such as at least about 450 Hv, such as at least about 475 Hv, or such as at least about 500 Hv. Exemplary doped nickel-cobalt materials, such as phosphorous-doped nickel-cobalt materials, may exhibit a hardness of less than about 500 Hv, such as less than about 475 Hv, or such as less than about 450 Hv.

Now referring to FIG. 11, the effects of prolonged heat exposure on exemplary doped nickel-cobalt materials will be discussed. A doped nickel-cobalt material, such as a phosphorous-doped nickel cobalt material, may be subjected to a prolonged heat exposure (e.g., at least 500 hours at about 650K to about 750K (about 376.9° C. to about 476.9° C.)) due to the operating environment in which the material may be used. With prolonged heat exposure, pinning and/or intragranular twinning in the doped nickel-cobalt material would be expected to provide a thermally stable material that exhibits somewhat enhanced ductility relative to both the as-deposited material and the material after a precipitate strengthening heat treatment, while still maintaining good tensile strength. As shown in FIG. 11, an exemplary doped nickel-cobalt material, such as a phosphorous-doped nickel cobalt material, would be expected to exhibit prolonged heat exposure stress-strain curve, which may fall within an expected prolonged heat exposure stress-strain range 1100. As indicated, the material would be expected to exhibit thermal stability such that the tensile strength properties may be generally preserved with prolonged heat exposure. The prolonged heat exposure would be expected to reduce tensile strength somewhat relative to the precipitate strengthened stress-strain range 1002. However, good tensile strength would be expected to be preserved because of pinning and/or intragranular twinning, and in some embodiments the prolonged heat exposure stress-strain range 1100 may overlap the as-deposited stress-strain curve 1000 and/or the precipitate strengthened stress-strain range 1002.

EXAMPLES

Example 1—Tensile Strength and Ductility

A precursor phosphorous-doped nickel-cobalt nanocrystalline material was formed using an electrodeposition process. The electrodeposition process was performed in a Watts bath with a temperature within the range of 35° C. to 60° C., and a Dynatronix 12-1010 power supply providing a current density in the range of 0 to 600 mA/cm$^2$, and an average current density of 15 mA/cm$^2$ or 25 mA/cm$^2$. The precursor material was formed on a stainless-steel substrate and had dimensions of 5 inches wide, 5 inches long, and 0.040 inches thick. The precursor material resulting from the electrodeposition process was a phosphorous-doped nickel-cobalt alloy containing about 30% by weight cobalt and about 70% by weight nickel. Input parameters and resulting deposit compositions for the precursor materials are shown in Table 1.

TABLE 1

Room Temperature Tensile Properties

| | Sample ID | KB108 | KB110 | KB115 | KB118 |
|---|---|---|---|---|---|
| Input Parameters | Phosphorous Level | Medium | Medium | High | High |
| | Power Supply | Dynatronix 12-1010 | Dynatronix 12-1010 | Dynatronix 12-1010 | Dynatronix 12-1010 |
| | Average Current Density | 15 mA/cm$^2$ | 25 mA/cm$^2$ | 15 mA/cm$^2$ | 25 mA/cm$^2$ |
| Deposit | Phosphorous | 1018 ppm | 1095 ppm | 1313 ppm | 1473 ppm |

TABLE 1-continued

| Room Temperature Tensile Properties | | | | | |
|---|---|---|---|---|---|
| | Sample ID | KB108 | KB110 | KB115 | KB118 |
| Composition | concentration (EPMA) | | | | |
| | Sulfur Concentration (EPMA) | 102 ppm | 113 ppm | 118 ppm | 98 ppm |
| | Cobalt Concentration | 31 wt. % | 31 wt. % | 32 wt. % | 33 wt. % |

Tensile specimens were prepared, some of which were subjected to a precipitate strengthening heat treatment for 24 hours at 700° F. (about 371.1° C.). The heat treatment was performed using a salt/oil bath. The test specimen were bagged and then placed into the bath for heat treatment. The specimen were air cooled following heat treatment.

Tensile testing was performed on as-deposited and on the precipitate strengthened (heat treated) tensile specimen at room temperature (about 21° C.) using an extensometer in accordance with ASTM E21-17. The samples had an original length of about 0.12 inches and original thickness of about 0.05 inches. Results from the tensile testing are shown in Table 2.

TABLE 2

| Room Temperature Tensile Properties | | | | | | | | |
|---|---|---|---|---|---|---|---|---|
| | As-deposited | | 24 hr @ 700 F. HT | | As-deposited | | 24 hr @ 700 F. HT | |
| Specimen | UTS (ksi) | UTS (MPa) | UTS (ksi) | UTS (MPa) | Yield (0.2%) (ksi) | Yield (0.2%) (MPa) | Yield (0.2%) (ksi) | Yield (0.2%) (MPa) |
| KB108 | 208 | 1427 | 217 | 1494 | 132 | 913 | 187 | 1286 |
| KB110 | 166 | 1145 | 169 | 1165 | 108 | 747 | 143 | 986 |
| KB115 | 220 | 1516 | 249 | 1720 | 143 | 987 | 116 | 1489 |
| KB118 | 193 | 1334 | 205 | 1412 | 133 | 914 | 176 | 1215 |
| Mean | 197 | 1356 | 210 | 1448 | 129 | 890 | 156 | 1244 |

Example 3—Isochronal Heat-Treatment Study

An isochronal heat treatment study was performed on precursor materials that were prepared in the manner described in Example 1. The precursor materials included varying levels of phosphorous, as shown in Table 3. The precursor materials were exposed to exposed to an isochronal heat treatment at different temperatures and then indirectly tested for grain growth via hardness. The onset temperature $T_{onset}$ for grain growth was determined by identifying initial decrease in hardness is shown in Table 3.

TABLE 3

| Isochronal Heat-Treatment Study | | | |
|---|---|---|---|
| Specimen | Phosphorous concentration (EPMA) | Cobalt Concentration | Grain Growth Onset Temperature |
| KB103 | 537 ppm | 26 wt. % | about 800° F. (about 426.7° C.). |
| KB110 | 1095 ppm | 31 wt. % | about 800° F. (about 510° C.). |
| KB118 | 1473 ppm | 33 wt. % | about 800° F. (about 510° C.). |

Example 4—Tensile Strength at High Temperature

Tensile testing was also performed on heat treated tensile specimen at elevated temperature (650° F. (about 376.9° C.)) in accordance with ASTM E8-16a. The heat treated tensile specimen were prepared as described with reference to Example 1. Results from the elevated temperature tensile testing are shown in Table 4.

TABLE 4

| Elevated Temperature (650° F.) Tensile Properties | | |
|---|---|---|
| | 24 hr @ 700 F. HT | |
| Specimen | UTS (ksi) | UTS (MPa) |
| KB108 | 154 | 1063 |
| KB110 | 123 | 849 |
| KB115 | 169 | 1104 |
| KB118 | 155 | 1074 |
| Mean | 148 | 1022 |

Figure 12:
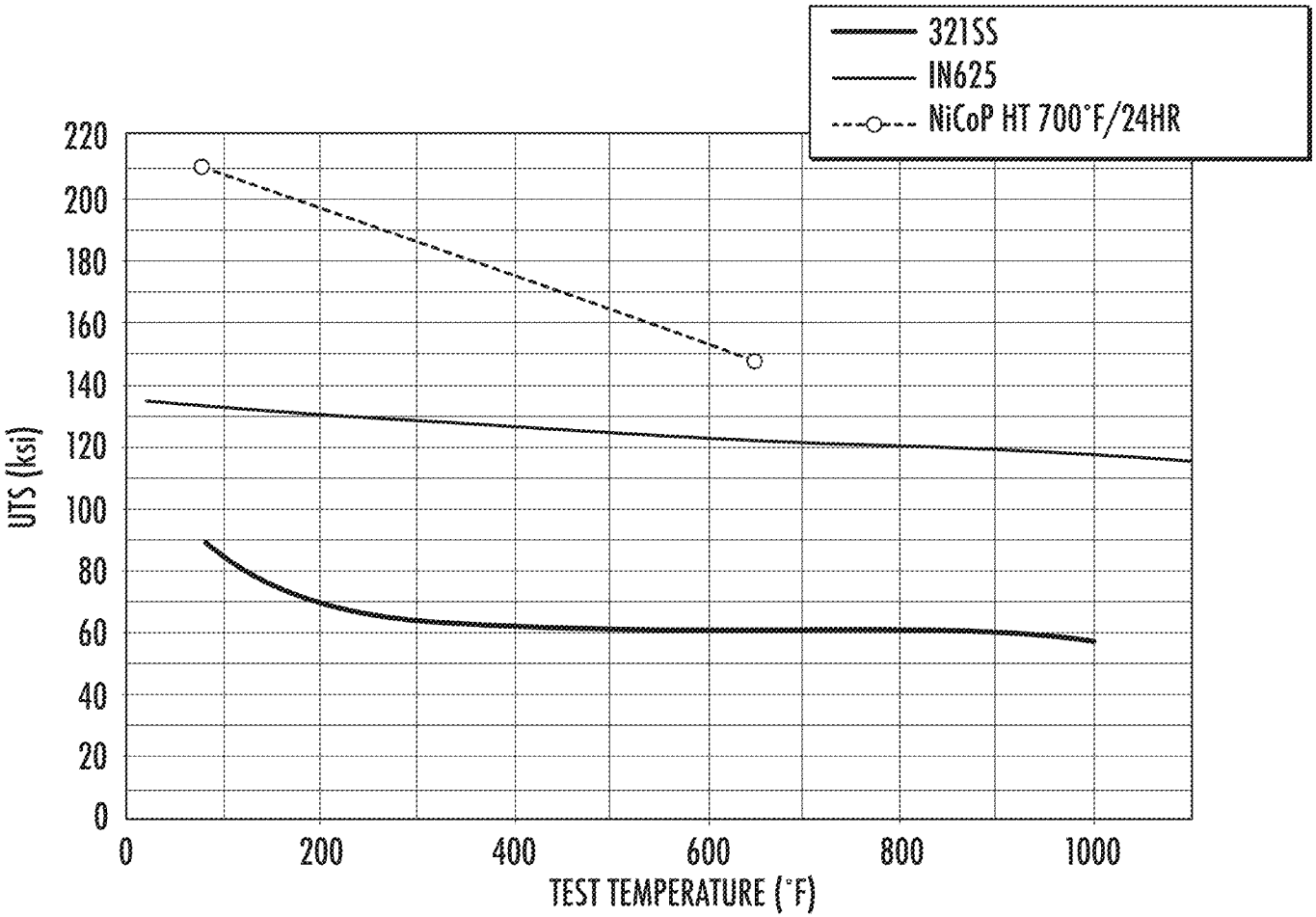
FIG. 12 shows plots of ultimate tensile strength values obtained at high temperatures for various exemplary metals, illustrating enhanced tensile strength at high temperature for exemplary nickel-cobalt material.

FIG. 12 shows the ultimate tensile strength of the precipice strengthened tensile specimen relative to literature values for stainless steel (321SS) and a nickel-based superalloy (INCONEL® 625). As shown, the precipitate strengthened tensile specimen exhibited a higher ultimate tensile strength both at room temperature (about 21° C.) and at an elevated temperature of 650° F. (37.8° C. to 343.3° C.) relative to the stainless steel (321SS) and the nickel-based superalloy (INCONEL® 625) literature values.

Example 5—Microstructure of Phosphorous-Doped Nickel-Cobalt Material

Figure 13A:
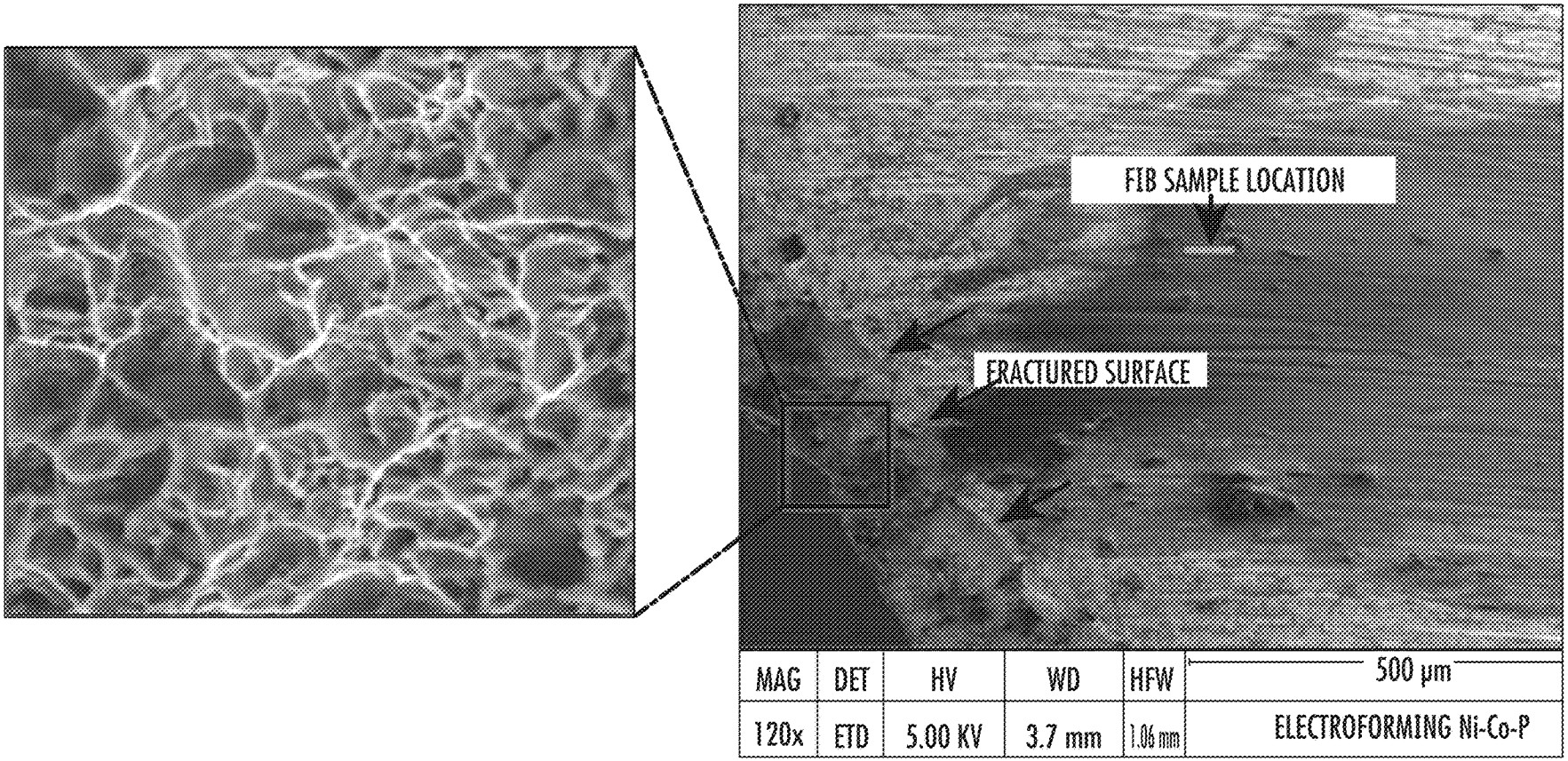
FIGS. 13A and 13B show transmission electron microscopy images of an exemplary nickel-cobalt material.

A tensile specimen was prepared as described with reference to Example 1. The tensile specimen received a precipice strengthening heat treatment at 700° F. (371.1° C.) for 500 hours. Tensile testing was performed on the tensile specimen at room temperature using an extensometer in accordance with ASTM E21-17. A fracture surface of tensile specimen was analyzed using transmission electron microscopy. Images obtained from the transmission electron microscope are shown in FIG. 13A. The fracture surface shows evidence of ductile rupture with extensive cupping of the grain, which indicates high ductility.

Figure 13B:
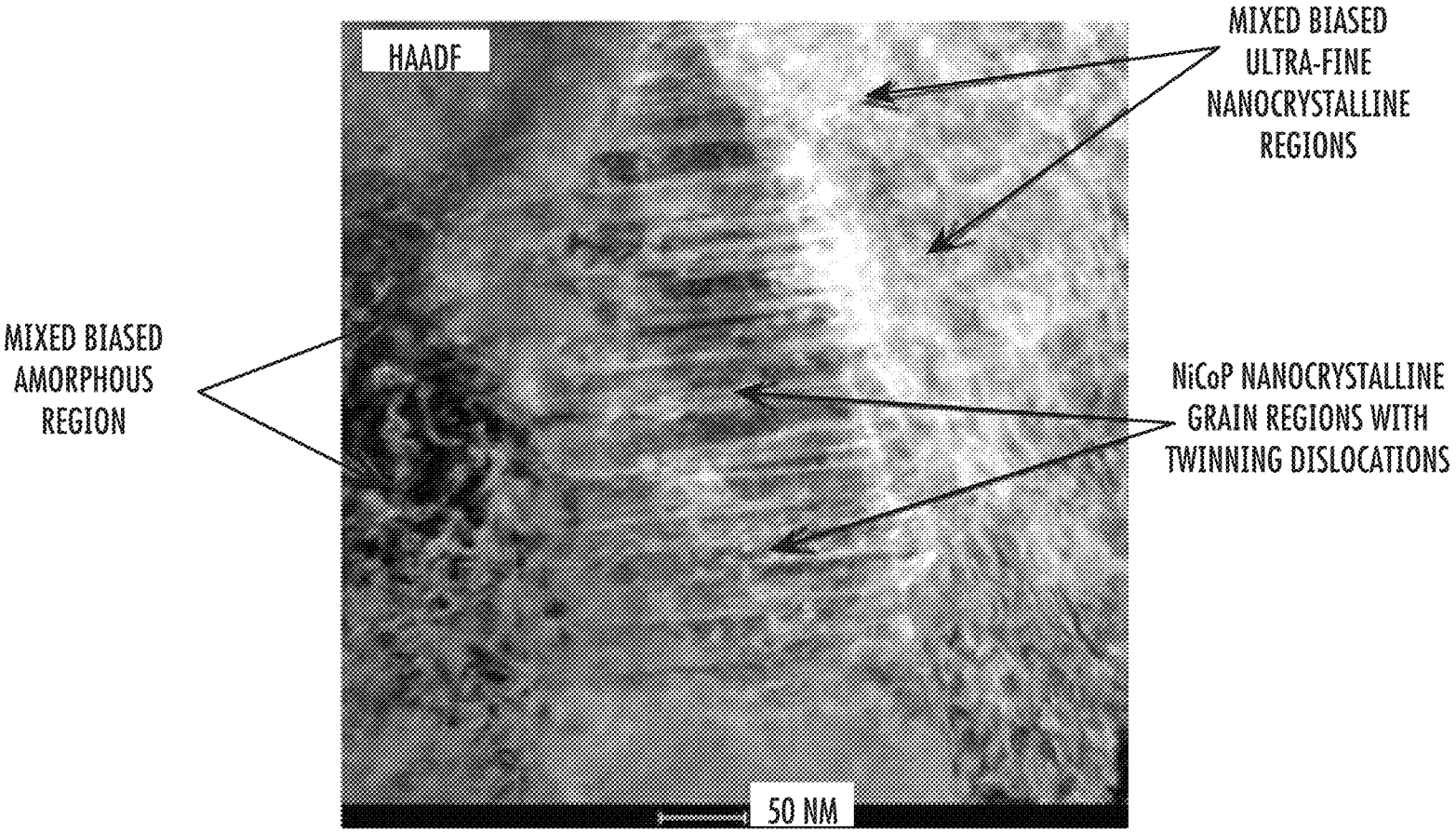

Focused ion beam (FIB) machining was used to remove a section adjacent to the fracture region and the location subjected to the FIB machining was analyzed using electron microscopy. An image obtained from the transmission electron microscope is shown in FIG. 13B. The image obtained from the transmission electron microscope shows a multimodal composite of amorphous regions and crystalline regions, with the crystalline regions including ultrafine nanocrystalline grain regions, nanocrystalline grain regions, and coarse grain regions. The nanocrystalline grain regions and coarse grain regions exhibited intragranular twinning, which are believed to be a combination of both annealing twins and distortion twins. The presence of annealing twins in the intragranular twinning shown in FIG. 13B is evidenced by the ductile rupture and extensive cupping of the grain shown in FIG. 13A, together with the improved tensile and ductility properties from Examples 1 and 4.

It is understood that the terms "first", "second", and "third" may be used interchangeably to distinguish one component from another and are not intended to signify location or importance of the individual components. The terms "a" and "an" do not denote a limitation of quantity, but rather denote the presence of at least one of the referenced item. Here and throughout the specification and claims, range limitations are combined and interchanged, and such ranges are identified and include all the sub-ranges contained therein unless context or language indicates otherwise. For example, all ranges disclosed herein are inclusive of the endpoints, and the endpoints are independently combinable with each other.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value, or the precision of the methods or machines for constructing or manufacturing the components and/or systems.

Further aspects of the invention are provided by the subject matter of the following clauses:

1. A method of forming a nickel-cobalt material, the method comprising:

heat treating a nickel-cobalt material within a first temperature zone below the onset temperature for grain growth in the material, the first temperature zone being from about 600K to about 750K (about 326.9° C. to about 476.9° C.).

2. The method of any preceding clause, comprising: heat treating the material within a second temperature zone above the onset temperature for grain growth in the material, the second temperature zone being from about 800K to about 900K (from about 526.9° C. to about 626.9° C.).
3. The method of any preceding clause, wherein the nickel-cobalt material comprises a doped nickel-cobalt material, the doped nickel-cobalt material formed using an electrodeposition process.
4. The method of any preceding clause, wherein the doped nickel-cobalt material comprises a dopant, the dopant comprising aluminum, antimony, arsenic, boron, beryllium, cadmium, carbon, chromium, copper, erbium, europium, gallium, germanium, gold, iron, indium, iridium, lead, magnesium, manganese, mercury, molybdenum, niobium, neodymium, palladium, phosphorus, platinum, rhenium, rhodium, selenium, silicon, sulfur, tantalum, tellurium, tin, titanium, tungsten, vanadium, zinc, and/or zirconium.
5. The method of any preceding clause, wherein the doped nickel-cobalt material comprises a dopant, the dopant comprising phosphorus.
6. The method of any preceding clause, wherein the doped nickel-cobalt material comprises a dopant, the dopant comprising boron.
7. The method of any preceding clause, wherein the nickel-cobalt material comprises a phosphorous-doped nickel-cobalt material, the phosphorous-doped nickel-cobalt material formed using an electrodeposition process.
8. The method of any preceding clause, wherein the nickel-cobalt material comprises from about 40% to 90% by weight nickel, from about 10% to about 60% by weight cobalt, and from about 100 ppm to about 20,000 ppm by weight of a dopant.
9. The method of any preceding clause, wherein the concentration of the dopant in the nickel-cobalt material is from about 1,000 ppm to about 2,500 ppm by weight.
10. The method of any preceding clause, wherein the nickel-cobalt material comprises from about 40% to 90% by weight nickel, from about 10% to about 60% by weight cobalt, and from about 100 ppm to about 20,000 ppm by weight of phosphorous.
11. The method of any preceding clause, wherein the concentration of the phosphorous in the nickel-cobalt material is from about 1,000 ppm to about 2,500 ppm by weight.
12. The method of any preceding clause, wherein the concentration of the cobalt in the nickel-cobalt material is at least about 25% by weight.
13. The method of any preceding clause, wherein the concentration of the nickel in the nickel-cobalt material is less than about 75% by weight.
14. The method of any preceding clause, comprising: forming the nickel-cobalt material using an electrodeposition process.
15. The method of any preceding clause, comprising: heat treating the nickel-cobalt material within the first temperature zone for a period of from 30 minutes to 36 hours.
16. The method of any preceding clause, comprising: heat treating the nickel-cobalt material within the first temperature zone for a period of from 2 hours to 18 hours.
17. The method of any preceding clause, comprising: heat treating the nickel-cobalt material within the second temperature zone for a period of from 10 minutes to 5 hours.
18. The method of any preceding clause, comprising: heat treating the nickel-cobalt material within the second temperature zone for a period of from 30 minutes to 3 hours.
19. A method of thermally stabilizing a nickel-cobalt material, the method comprising: heat treating a nickel-cobalt material within a temperature zone below the onset temperature for grain growth in the nickel-cobalt material, wherein the nickel-cobalt material comprises a dopant, the concentration of the dopant in the nickel-cobalt material being from about 1,000 ppm to about 2,500 ppm by weight, and the concentration of the cobalt in the nickel-cobalt material being from about 30% to about 50% by weight.
20. The method of any preceding clause, wherein the dopant comprises aluminum, antimony, arsenic, boron, beryllium, cadmium, carbon, chromium, copper, erbium, europium, gallium, germanium, gold, iron, indium, iridium, lead, magnesium, manganese, mercury, molybdenum, niobium, neodymium, palladium, phosphorus, platinum, rhenium, rhodium, selenium, silicon, sulfur, tantalum, tellurium, tin, titanium, tungsten, vanadium, zinc, and/or zirconium.

21. The method of any preceding clause, wherein the dopant comprises phosphorus.
22. The method of any preceding clause, wherein the dopant comprises boron.
23. The method of any preceding clause, wherein the nickel-cobalt material was formed using an electrodeposition process.
24. The method of any preceding clause, comprising: forming the nickel-cobalt material using an electrodeposition process.
25. The method of any preceding clause, wherein the temperature zone below the onset temperature for grain growth in the nickel-cobalt material is from about 600K to about 750K (about 326.9° C. to about 476.9° C.), optionally from about 630K to about 660K (about 356.9° C. to about 386.9° C.).
26. The method of any preceding clause, wherein prior to heat treating, the nickel-cobalt material comprises a nanocrystalline grain structure having a grain size distribution of about 20 to 100 nanometers substantially encompassing the nickel-cobalt material.
27. The method of any preceding clause, wherein after heat treating, the nickel-cobalt material comprises a nanocrystalline grain structure having a grain size distribution of about 20 to about 100 nanometers substantially encompassing the nickel-cobalt material.
28. The method of any preceding clause, comprising: heat treating the nickel-cobalt material within a temperature zone above the onset temperature for grain growth in the material, providing a metal matrix composite comprising amorphous metal regions and crystalline grain regions, the crystalline grain regions having a grain size distribution of about 50 to about 800 nanometers.
29. The method of any preceding clause, wherein the temperature zone above the onset temperature for grain growth in the nickel-cobalt material is from about 800K to about 900K (from about 526.9° C. to about 626.9° C.).
30. The method of any preceding clause, wherein prior to heat treating within the temperature zone below the onset temperature for grain growth, the nickel-cobalt material comprises a metal matrix composite substantially encompassing the nickel-cobalt material, the metal matrix composite having amorphous metal regions and ultra-fine nanocrystalline grain regions.
31. The method of any preceding clause, wherein the ultra-fine nanocrystalline grain regions have a grain size distribution of from about 5 to 50 nanometers.
32. The method of any preceding clause, wherein after heat treating, the nickel-cobalt material exhibits an elongation strain from about 0.05 mm/mm to about 0.08 mm/mm as determined according to ASTM E8-16a.
33. The method of any preceding clause, wherein after heat treating, the nickel-cobalt material exhibits an ultimate tensile strength of from about 1,000 MPa to about 1,500 MPa as determined according to ASTM E8-16a.
34. A nickel-cobalt material, comprising: a metal matrix composite with amorphous regions and crystalline regions, the crystalline regions substantially encompassed by a nanocrystalline grain structure with a grain size distribution of about 50 nanometers to about 800 nanometers, the nanocrystalline grain structure comprising widespread intragranular twinning (e.g., about 30% to about 40%, or even about 40% to 50%, of the nanocrystalline grain structure comprising intragranular twinning), the metal matrix composite having a chemical makeup comprising from about 50% to 80% by weight nickel, from about 20% to about 50% by weight cobalt, and from about 100 ppm to about 20,000 ppm by weight of a dopant.
35. The nickel-cobalt material of any preceding clause, wherein the dopant comprises aluminum, antimony, arsenic, boron, beryllium, cadmium, carbon, chromium, copper, erbium, europium, gallium, germanium, gold, iron, indium, iridium, lead, magnesium, manganese, mercury, molybdenum, niobium, neodymium, palladium, phosphorus, platinum, rhenium, rhodium, selenium, silicon, sulfur, tantalum, tellurium, tin, titanium, tungsten, vanadium, zinc, and/or zirconium.
36. The nickel-cobalt material of any preceding clause, wherein the dopant comprises phosphorus.
37. The nickel-cobalt material of any preceding clause, wherein the dopant comprises boron.
38. The nickel-cobalt material of any preceding clause, wherein the nickel-cobalt material exhibits an elongation strain from about 0.05 mm/mm to about 0.08 mm/mm as determined according to ASTM E8-16a, and an ultimate tensile strength of from about 1,000 MPa to about 1,500 MPa as determined according to ASTM E8-16a.
39. The nickel-cobalt material of any preceding clause, wherein the nickel-cobalt material was formed according to the method of any preceding clauses.

This written description uses exemplary embodiments to describe the presently disclosed subject matter, including the best mode, and also to enable any person skilled in the art to practice such subject matter, including making and using any devices or systems and performing any incorporated methods. The patentable scope of the presently disclosed subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of forming a nickel-cobalt material, the method comprising:

heat treating the nickel-cobalt material within a first temperature zone from about 600K to about 750K, the nickel-cobalt material comprising between 40-90% by weight nickel and between 10-60% by weight cobalt, wherein the first temperature zone is below an onset temperature for grain growth in the nickel-cobalt material.

2. The method of claim 1, further comprising:

heat treating the nickel-cobalt material within a second temperature zone above the onset temperature for grain growth in the nickel-cobalt material, the second temperature zone being from about 800K to about 900K.

3. The method of claim 1, wherein the nickel-cobalt material comprises a doped nickel-cobalt material, the doped nickel-cobalt material formed using an electrodeposition process.

4. The method of claim 3, wherein the doped nickel-cobalt material comprises a dopant, the dopant comprising aluminum, antimony, arsenic, boron, beryllium, cadmium, carbon, chromium, copper, erbium, europium, gallium, germanium, gold, iron, indium, iridium, lead, magnesium, manganese, mercury, molybdenum, niobium, neodymium, palladium, phosphorus, platinum, rhenium, rhodium, selenium, silicon, sulfur, tantalum, tellurium, tin, titanium, tungsten, vanadium, zinc, and/or zirconium.

5. The method of claim 1, wherein the nickel-cobalt material comprises a phosphorous-doped nickel-cobalt material, the phosphorous-doped nickel-cobalt material formed using an electrodeposition process.

6. The method of claim 1, wherein the nickel-cobalt material comprises from about 100 ppm to about 20,000 ppm by weight of a dopant.

7. The method of claim 6, wherein a concentration of the dopant in the nickel-cobalt material is from about 1,000 ppm to about 2,500 ppm by weight.

8. The method of claim 1, wherein the nickel-cobalt material comprises from about 100 ppm to about 20,000 ppm by weight of phosphorous.

9. The method of claim 1, further comprising:

heat treating the nickel-cobalt material within the first temperature zone for a period of from 30 minutes to 36 hours.

10. The method of claim 2, further comprising:

heat treating the nickel-cobalt material within the second temperature zone for a period of from 10 minutes to 5 hours.

11. The method of claim 1, wherein prior to heat treating, the nickel-cobalt material comprises a nanocrystalline grain structure having a grain size distribution of about 20 to 100 nanometers substantially encompassing the nickel-cobalt material.

12. The method of claim 1, wherein after heat treating, the nickel-cobalt material comprises a nanocrystalline grain structure having a grain size distribution of about 20 to about 100 nanometers substantially encompassing the nickel-cobalt material.

13. The method of claim 1, further comprising:

heat treating the nickel-cobalt material within a temperature zone above the onset temperature for grain growth in the nickel-cobalt material, providing a metal matrix composite comprising amorphous metal regions and crystalline grain regions, the crystalline grain regions having a grain size distribution of about 50 to about 800 nanometers.

14. The method of claim 13, wherein the temperature zone above the onset temperature for grain growth in the nickel-cobalt material is from about 800K to about 900K.

15. The method of claim 14, wherein prior to heat treating within the temperature zone below the onset temperature for grain growth, the nickel-cobalt material comprises a metal matrix composite substantially encompassing the nickel-cobalt material, the metal matrix composite having amorphous metal regions and ultra-fine nanocrystalline grain regions.

16. The method of claim 1, wherein the first temperature zone is between 625-650 K, and wherein the nickel-cobalt material comprises 30% by weight cobalt.

17. The method of claim 1, wherein the first temperature zone is between 650-700 K.

18. The method of claim 17, further comprising heat treating the nickel-cobalt material within a second temperature zone above the onset temperature for grain growth in the nickel-cobalt material, wherein the second temperature zone is between 700-750 K.

19. A method of forming a nickel-cobalt material, the method comprising:

performing a heat treatment on a precursor material to determine an onset temperature for grain growth in the nickel-cobalt material; and heat treating the nickel-cobalt material within a first temperature zone from about 600K to about 750K, wherein the first temperature zone is below the onset temperature for grain growth.

20. The method of claim 19, wherein the heat treatment comprises an isochronal heat treatment.

* * * * *